US005400567A

United States Patent [19]

Lindstrand

[11] Patent Number: 5,400,567

[45] Date of Patent: Mar. 28, 1995

[54] METHOD OF MANUFACTURING A COIL OF A CONTINUOUS FLEXIBLE OBJECT AND ENVELOPING THE COIL TO FORM A PARCEL

[75] Inventor: Ulf Lindstrand, Fengersfors, Sweden

[73] Assignee: Ulvator Aktiebolag, Enkoping, Sweden

[21] Appl. No.: 930,660

[22] PCT Filed: Apr. 9, 1991

[86] PCT No.: PCT/SE91/00255

§ 371 Date: Oct. 2, 1992

§ 102(e) Date: Oct. 2, 1992

[87] PCT Pub. No.: WO91/16261

PCT Pub. Date: Oct. 31, 1991

[30] Foreign Application Priority Data

Apr. 12, 1990 [SE] Sweden ..... 9001334

[51] Int. Cl.[6] ..... B65B 13/02; B65B 63/04

[52] U.S. Cl. ..... 53/399; 53/116; 53/118; 53/430; 53/582; 242/614; 242/608.4

[58] Field of Search ..... 53/116, 118, 399, 409, 53/430, 449, 176, 581, 585, 590, 589, 592, 390, 204; 242/115, 116, 608.4, 614

[56] References Cited

U.S. PATENT DOCUMENTS

| | | | |
|---|---|---|---|
| 2,457,094 | 12/1948 | Smith | 53/430 |
| 2,695,142 | 11/1954 | Fons | 242/115 |
| 2,875,561 | 3/1959 | Spence | 53/409 |
| 2,943,807 | 7/1960 | Loop | 242/116 |
| 3,652,026 | 3/1972 | Awebro . | |
| 3,856,141 | 12/1974 | Reed | 53/409 X |
| 4,580,739 | 4/1986 | Linder | 53/118 X |
| 4,707,968 | 11/1987 | Vosters | 53/430 |
| 4,871,125 | 10/1989 | Haueter | 53/430 X |

FOREIGN PATENT DOCUMENTS

| | | | |
|---|---|---|---|
| 559583 | 7/1958 | Canada | 53/430 |
| 147711 | 7/1985 | European Pat. Off. . | |
| 320751 | 6/1989 | European Pat. Off. . | |
| 2240635 | 4/1975 | France . | |
| 454981 | 6/1988 | Sweden . | |
| 2053848 | 2/1981 | United Kingdom . | |

*Primary Examiner*—Linda B. Johnson
*Attorney, Agent, or Firm*—Nixon & Vanderhye

[57] ABSTRACT

A method of manufacturing a coil (1) of a continuous flexible object (2), such as cable and line, and enveloping the coil to form a parcel (27) for delivery to a user, said object (2) being coiled onto an axially open, cylindrical sleeve (28) to produce said coil. According to the invention the sleeve (28) is provided with two protective rings (29, 30) and is brought to be fixed by a first tool (9) so that the sleeve (28) is firmly clamped between two parallel side supports (10, 11) and centered by centering elements (24) of the side supports, whereby a first rotatable unit (36) is formed. The cable or line (2) is attached to said first unit (36) and the unit (36) is brought to rotate in a coiling machine (3) so that the cable or line is formed to said coil (1). When the cable or line has been cut, a protective casing (40) is brought to surround the coil (1) between the protective rings (29, 30), and a plurality of bands (41) are brought to surround the sleeve (28) from the inside thereof, the protective rings (29, 30), the protective casing (40) and the coil (1) enclosed within these parts, without engagement with the side supports (10, 11), after which the bands (41) are tightened and their ends joined in a strong joint to form said parcel (27). A system is also described for handling the cable or line which is prepared and enveloped in the manner described, as well as tools of the structure described above and cable or line parcels manufactured according to said method.

26 Claims, 18 Drawing Sheets

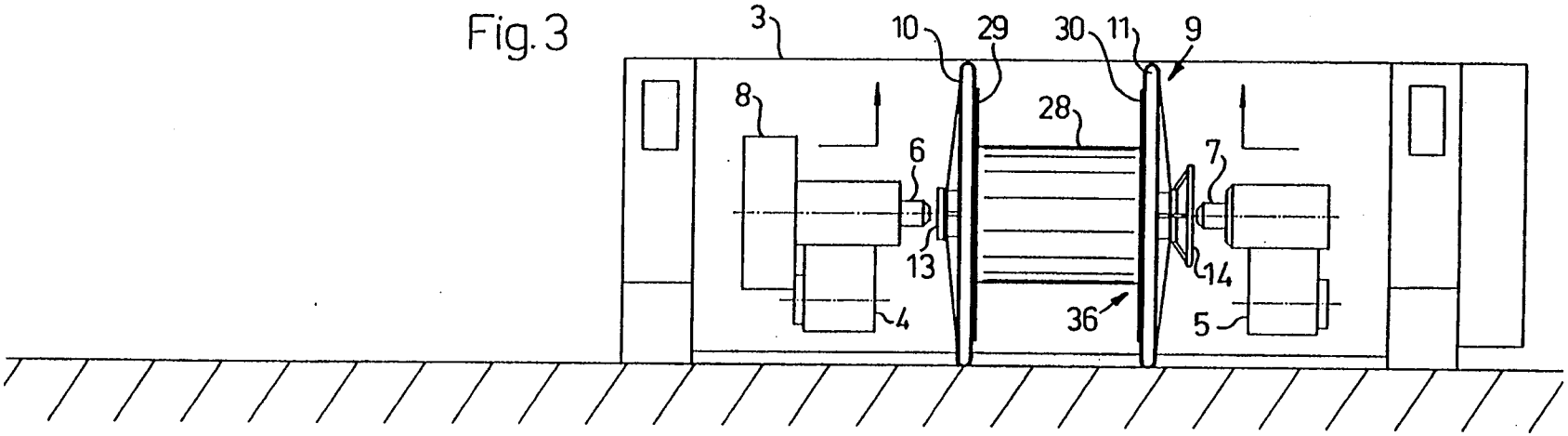
Fig. 3
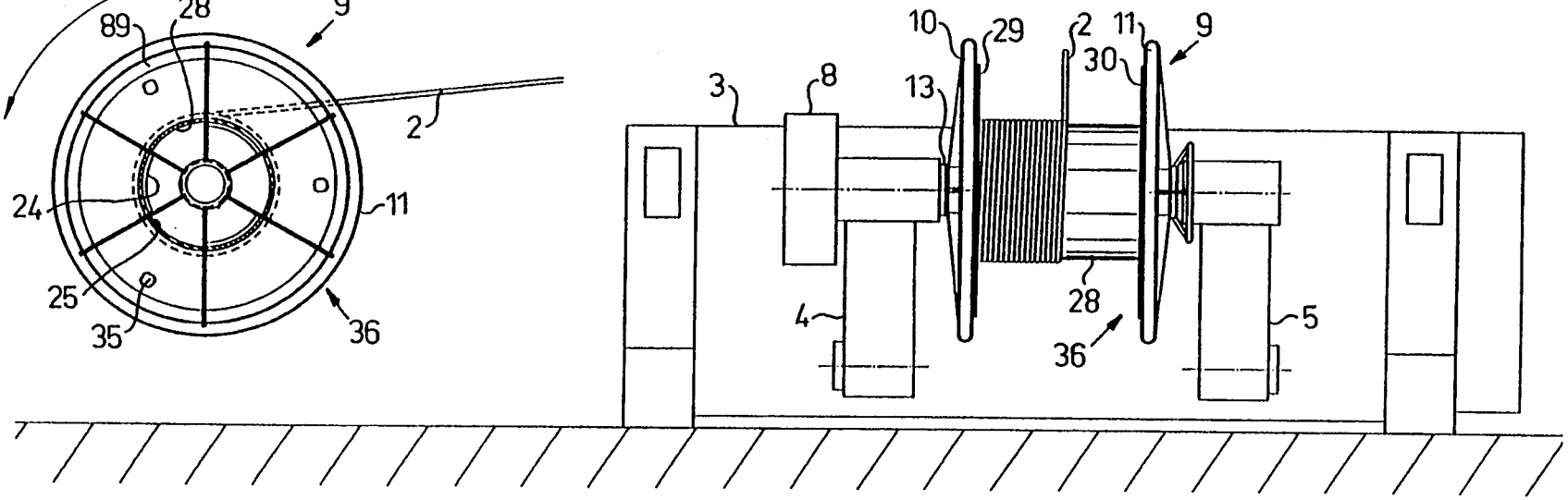
Fig. 4a
Fig. 4b 9
10
11
13
14
40
41
46
27
1
29
35
21

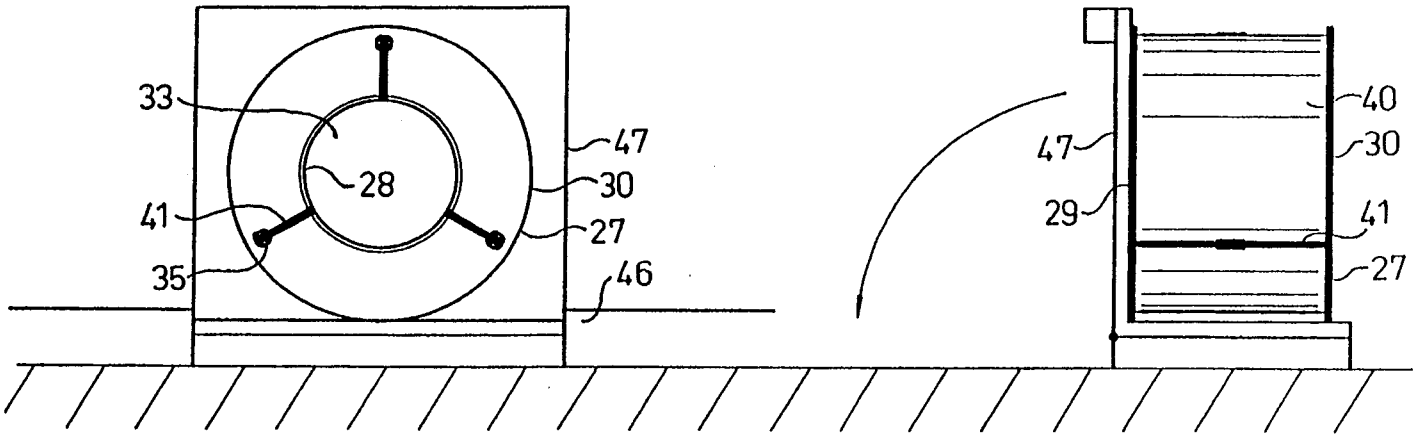
Fig. 11b
Fig. 11a
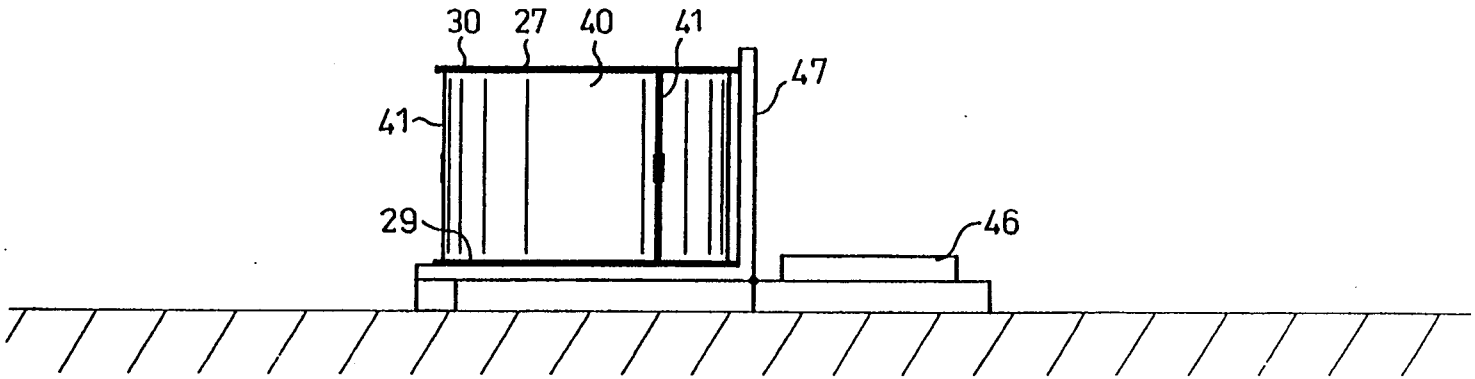
Fig. 11c 48
52
54
57
58
55
56
30
41
27
40
53
29
84
60
59

Fig. 18
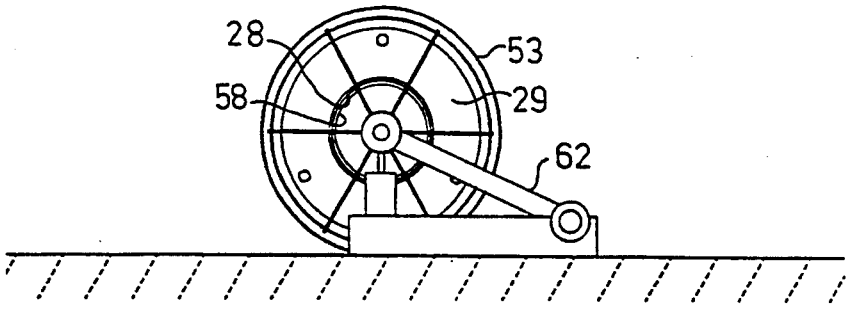
Fig. 19b
Fig. 19a
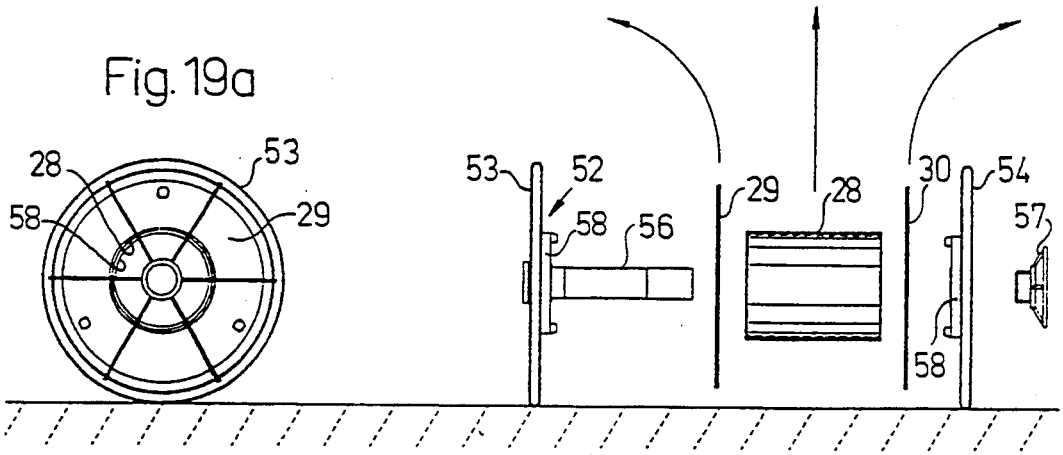

METHOD OF MANUFACTURING A COIL OF A CONTINUOUS FLEXIBLE OBJECT AND ENVELOPING THE COIL TO FORM A PARCEL

The present invention relates to a method of manufacturing a coil of a continuous flexible object, comprising cable, line, wire, wire cable, rope, cord, ribbon, hosing, chain and the like, and enveloping the coil to form a parcel for delivery to a user of the object, said object being coiled onto an axially open, cylindrical sleeve to produce said coil. The invention also relates to a new system for handling a continuous flexible object, comprising cable, line, wire, wire cable, rope, cord, ribbon, hosing, chain and the like, said handling procedure starting with manufacturing a coil and enveloping the coil to form a parcel for delivery to a user, which object is coiled onto an axially open, cylindrical sleeve to produce said coil. The invention also relates to a tool for use with this method and in this system, as well as parcels produced by the method.

The system generally used hitherto for handling live cable and line, for instance, such as bare line for overhead power transmission lines, has a number of drawbacks. With the known system drums made of wood material, usually planks, are used which have a core and two end pieces which are rigidly secured to each other and the core by means of nail and/or screw joints. The end pieces are provided with small central holes, the edges of which usually being formed by the wood material of the end pieces. The end pieces determine the outer dimensions of the cable and line drums and thus the space required for storing empty cable and line drums. Considerable transport and store spaces are therefore need for transporting and storing them before coiling is performed. A drum of the type described is placed in a coiling machine in order to coil a cable or line onto the core so that a coil of cable or line is produced having a diameter slightly less than the diameter of the end pieces. The drum of cable or line is then transferred from the coiling machine to an adjacent station where it is wrapped to protect the coil from impacts, in that boards are nailed between the end pieces to enclose the coil, or the coil being enclosed by a casing of corrugated cardboard material. The wrapped cable and line drums are then stored in an adjacent store for subsequent delivery, or are transported directly to the user. The cable or line installation must be prepared so that the cable or line drums are delivered at the desired places long before the actual installation takes place, usually about two months. During this time the drums are subjected to moisture and rain and even for direct contact with water on the ground so that there is a favourable environment for decay. When the cable or line is to be installed a drum is placed in a special uncoiling trestle at the start of the installation distance, while an empty drum is placed in a coiling trestle at the end of the installation distance. The old cable or line, or a special traction wire, is wound onto this empty drum.

In the coiling machine, and in the uncoiling and coiling trestles, journalling means are brought into engagement with the holes in the end pieces and these holes are consequently subjected to considerable strain resulting in the wooden material splintering. The risk of this increases greatly if the end pieces have been attacked by decay around the edges of the holes. The center of the hole will be displaced from the optimum axis of rotation, resulting in the drum and the coil becoming off-centered so that rotation of the drum becomes unbalanced. In the coiling machine this creates problems in coiling the cable or line in tight, uniform turns and may result in damage to the cable or line so that the entire coil must be rejected as well as the drum. The problem can be reduced by reducing the speed of rotation but this gives an undesired decrease in capacity. Due to the extremely rough treatment to which the drums are subjected, particularly during loading and unloading, the end pieces may be displaced laterally from each other so that the drum becomes deformed. This deformation may be difficult to detect before coiling is started in the coiling machine and causes the same problem as mentioned above with respect to the difficulty of forming tight uniform turns in the coil. In some cases bushings are used to reduce the risk of damage to the edges of the central holes in the end pieces, the bushings being inserted into correspondingly larger holes in the end pieces. However, even such bushings are subjected to strain so that they finally become loose and fall out. The holes are therefore too large for the journalling means used in the coiling machine and in the uncoiling and coiling trestles. Even if the end pieces are undamaged the hole may not have been correctly centered during manufacture of the end pieces, due to the difficulty of locating it concentrically with respect to the core around which the cable or line is to be wound. Furthermore, unbalance may occur in the drum because pieces of wood have loosened from the outer part of the end pieces as a result of the rough treatment to which the drum is subjected during transport between factory and work site, whereby any decay attack already on the drums, as mentioned above, will considerably increase the risk of pieces of wood coming loose from the end pieces. The off-centering and/or unbalance mentioned above causes considerable strain on the uncoiling trestles, particularly since uncoiling is usually carried out at relatively high speed. The speed may also vary so that sudden jerks occur in the cable or line, with consequent strain on the uncoiling trestle and its journalling means. When the strain becomes too great there is risk of the drum falling off the uncoiling trestles thereby causing an unacceptable stop in operations. The drum may then be damaged, often to such an extent that it cannot be replaced on the uncoiling trestles and the rest of the cable or line must be rejected as well as the drum. During uncoiling the cable or line may be pulled inclined so that it encounters the end pieces with the risk that if these end pieces are damaged at the edges, the cable or line will be damaged. This is entirely unacceptable and has extremely unfavourable consequences, particularly if the damage is not discovered before the high-voltage line or other power line is to be or has been taken into operation.

When the cable or line drums are being transported they must be placed so that their central axis is horizontal, to ensure that the turns of the cable remain close together in each layer, which is impossible if the drums are placed so that the central axis is vertical. The drums take considerably more space when standing than when lying and cannot be stored one on top of the other. When they are being loaded a fork truck must be used which is inserted under the end pieces, and the edges of these as well as the cable or line may easily be damaged during lifting, particularly if the edge portions have been attacked by decay. During unloading rods are applied through the central holes in order to provide a grip for a lifting device. The unloading work is therefore relatively time-consuming. Drums which have been placed out along the ground must then be lifted up and placed on the uncoiling trestles, which may be done with implements which may cause serious damage to the end pieces. In some cases the coil may even be intentionally engaged so that the cable or line is damaged.

The uncoiled empty wooden drums normally are to be returned to the factory to be used again. However, this return may be delayed for some considerable time and the wooden drums are therefore subjected to further damage by damp and water, resulting in decay attacks in the end pieces so that pieces of wood become detached and fall off the end pieces during the continued handling of the wooden drums. The rejection of empty drums for return is therefore also extremely high. The drums are so constructed that the user cannot himself rectify said damages to enable re-purchase and re-use. On the other hand, as mentioned above, the empty drums take up so much space that storage and transportation costs are unacceptably high and returning them is hardly profitable or not profitable at all for the user in relation to the cost of a new drum from the factory (which of course may be a returned drum). The cost for the user with respect to the re-use of empty drums is also unacceptably high if an independent company buys up the drums and then, after possibly repairing damaged drums, resells them to factories who deliver drums with cable or line.

After repeated use, the strength of a cable or line drum deteriorates and there is a risk that it finally cannot stand further rough treatment or the strain normally occuring on the work site, and the joint between at least one end piece and the core collapses. The coil of cable or line becomes unusable and, particularly if the work site is located far from a normal transport route, e.g. 200 km is not unusual in inaccessible areas such as the mountains, the broken drum is left at the work site. This entails increased material costs since the rejected coil of cable or line may have a value of thousands of USD, e.g. about 5000 USD. Furthermore, the forced rejection results in a very serious delay since the work must be discontinued and cannot continue until a new cable or line drum has been transported out to the more or less remote work site from, in the worst case, the factory supplying cable or line drums of the relevant type. Due to the large dimensions of the drums, determined by the end pieces, as much as possible of the space between the end pieces must be used for the cable or line, in order to reduce storage and transport costs. For this reason a large range of drums of various diameters, with respect to both end pieces and cores, must be kept in stock and used to deliver various types of cables and lines of different lengths and dimensions.

Another problem with wood drums is that they are impregnated with substances that are damaging to the environment. Damaged or used wooden drums may not therefore be burned in the countryside but must be taken to special depots for environmentally hazardous waste. Metal parts included may also be treated with substances damaging to the environment which also prevent the drums from being burned in the countryside. It will be understood that drums left out in the countryside without being returned constitute sources of emission of the above-mentioned damaging substances, quite apart from the danger of animals and people being damaged by nails and metal parts exposed during decomposition of the drums.

The recovery of the metal in a scrapped line which has been replaced by a new line and wound onto a new wooden drum is relatively expensive since the line must be removed from the wooden drum because the wooden drum cannot be burned together with the line partly due to its size and partly due to its content of foreign metals and chemicals.

It is clear from the above that the present system of handling cable and line for power transmission is associated with problems at practically all stages of the handling procedure. This in turn leads to high extra costs for the installation of cable and line. There is therefore a great need for providing a completely new, unitary system for handling cable, line and the like from coiling in the factory, at least to uncoiling on site. Solving problems in one of the stages gives only marginal effect, or may create new problems or accentuate problems in the other stages.

The object of the present invention is to provide a new method of manufacturing and packing a coil of a continuous flexible object of the type described, such as cable, line and the like for power distribution and telecommunication, and a new system of handling the cable, line or the like, which method and system eliminate the conventional wooden drums and thus the remarkably many drawbacks and problems caused by their use, and also results in valuable advantages and plus effects in all stages of handling from manufacture of the coil to recovery of scrap line if applicable.

The method and system according to the invention are substantially characterized in that a) the sleeve is provided with two flat protective rings having concentric support surfaces cooperating with opposite internal or external surfaces of the sleeve, b) that the sleeve is brought to be fixed by a first tool having two parallel side supports with concentric centering elements facing each other so that the sleeve is firmly clamped between the side supports and centered by their centering elements, whereby a first rotatable unit is formed, c) that said object is attached to said first unit and the unit is brought to rotate in a coiling machine so that the object is wound to form said coil, and d) that, when the object has been cut, a protective casing is brought to completely envelope the coil between the protective rings and a plurality of continuous binding means are brought to surround the sleeve from the inside thereof, the protective rings, the protective casing and the coil enclosed within these parts, without engagement with the side supports or their centering elements, after which each binding means is tightened and its opposite ends joined in a strong joint to form said parcel, in which the turns of the object of the coil are pressed against each other by the binding means without relative movement between the turns. Since the protective rings and the sleeve also constitute the wrapping material for the finished parcel, the packing stage is commenced already at the stage of manufacturing the coil.

The tool according to the invention is substantially characterized in that it comprises two identical wheel-like side supports provided on one side with concentric centering elements disposed to receive and center said sleeve, the side supports being intended to be displaced towards each other thereby clamping the centered sleeve between them and forming a rotatable unit.

The cable or line parcel, or more generally expressed the object parcel, according to the invention is substantially characterized in that it comprises two protective rings covering the ends of the coil and a protective casing which completely surrounds the outer surface of the coil, and that the parcel is held together by a plurality of binding means extending axially through the sleeve and encompassing the protective rings, the protective casing and the coil entirely enclosed therein, to form a permanent joint arranged to fix the turns of the object in the coil to each other so that they are unable to move in relation to each other.

Further objects and advantages of the invention will be clear from the following description of the preferred embodiments described with reference to the accompanying drawings.

FIG. 1 is an exploded view of the parts, including a sleeve and a first tool, which are assembled in conjunction with a coiling machine to produce a first rotatable unit.

FIGS. 2*a* and 2*b* are a side view and an end view, respectively of the rotatable first unit.

FIG. 3 is a side view of a coiling machine in starting position ready to receive the assembled first unit.

FIG. 4*a* illustrates a coiling machine in operation.

FIG. 4*b* is a side view of the rotating first unit in FIG. 4*a*.

Figure 7A:
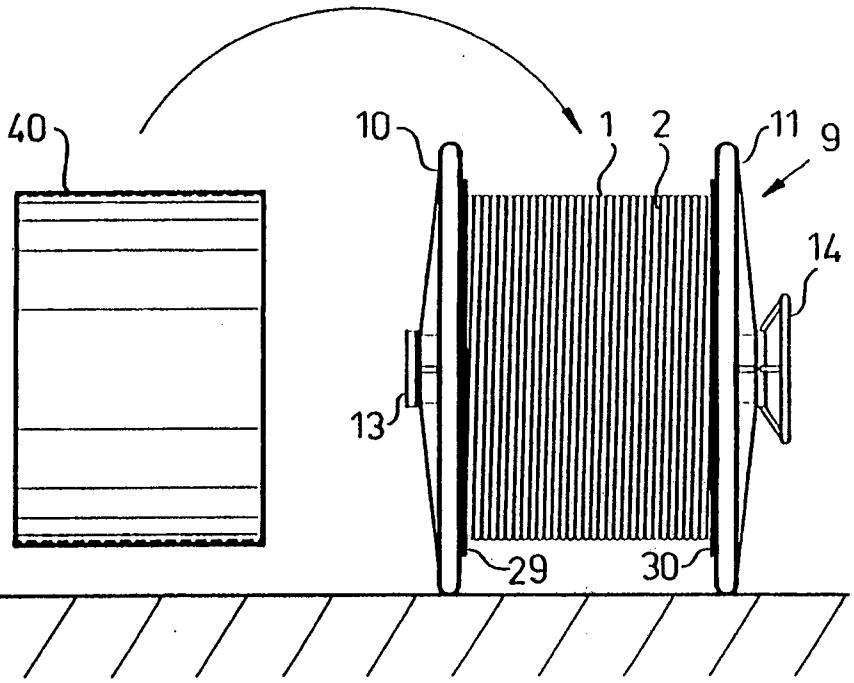
Figure 7B:
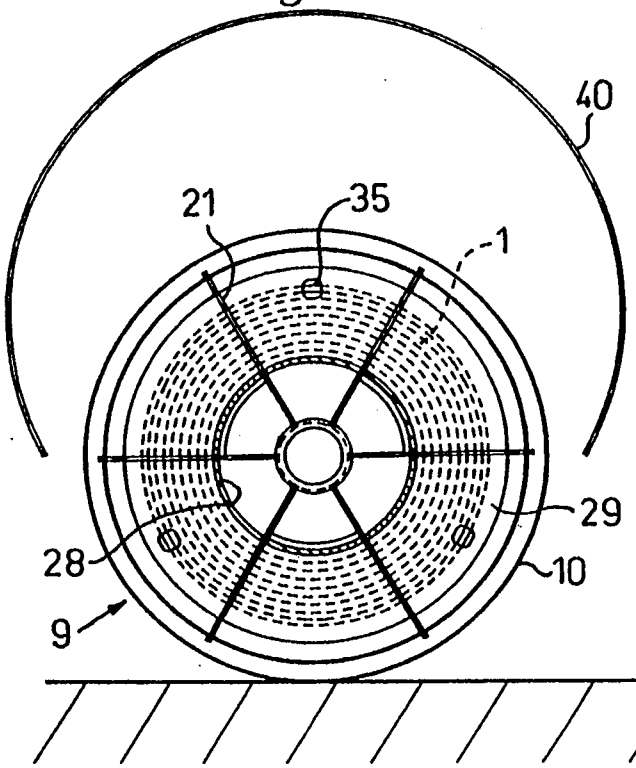

FIGS. 7*a* and 7*b* illustrate the first unit with finished coil during application of an outer protective casing.

Figures 8, 9A, 9B:
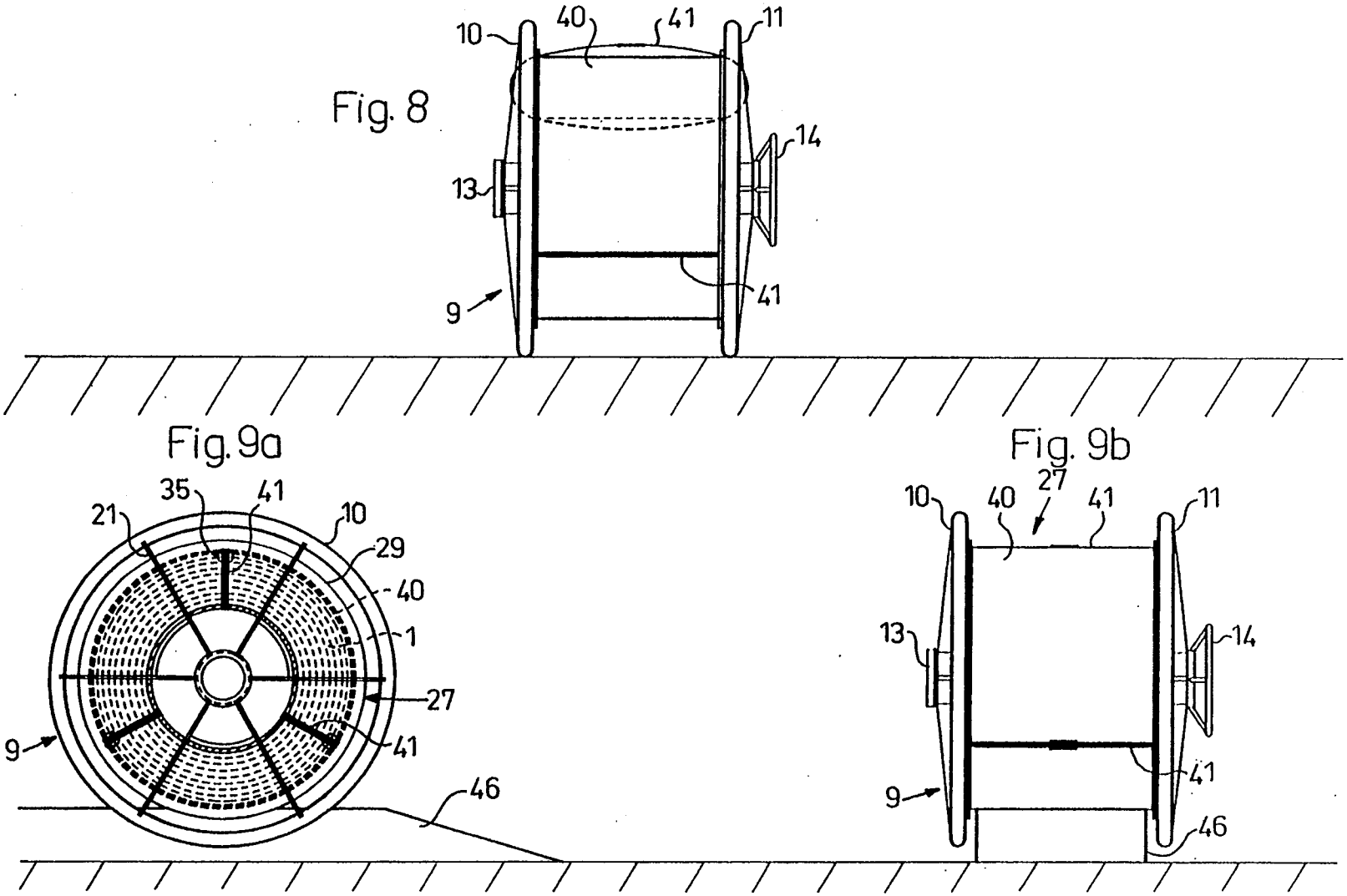

FIG. 8 illustrates application of bands to secure the turns of cable or line of the coil closely beside each other.

FIGS. 9*a* and 9*b* illustrate the first unit with enveloped coil rolled onto a ramp to enable dismantling of the tool.

Figure 10A:
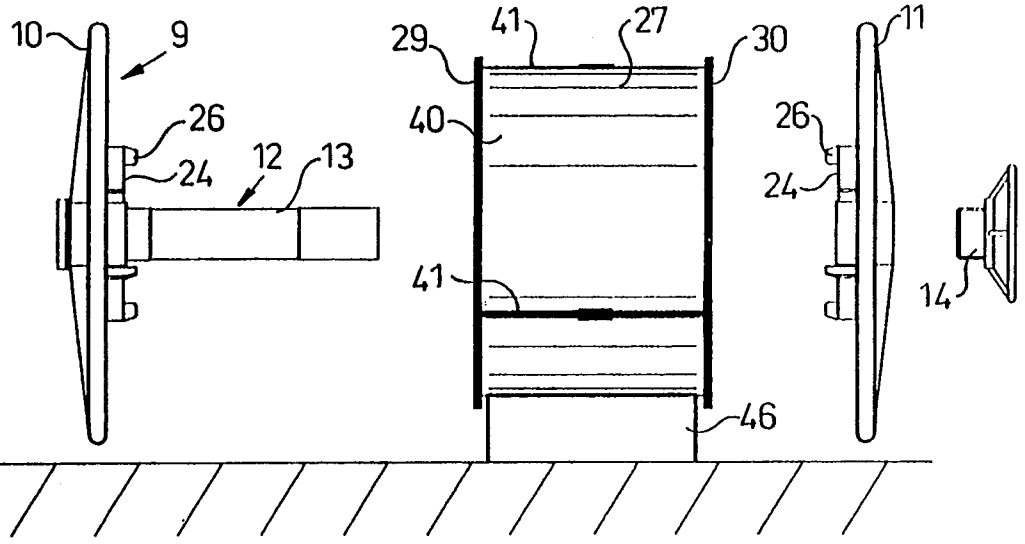

FIG. 10*a* illustrates dismantling of the tool and release of the finished cable or line parcel from the first unit.

Figure 10B:
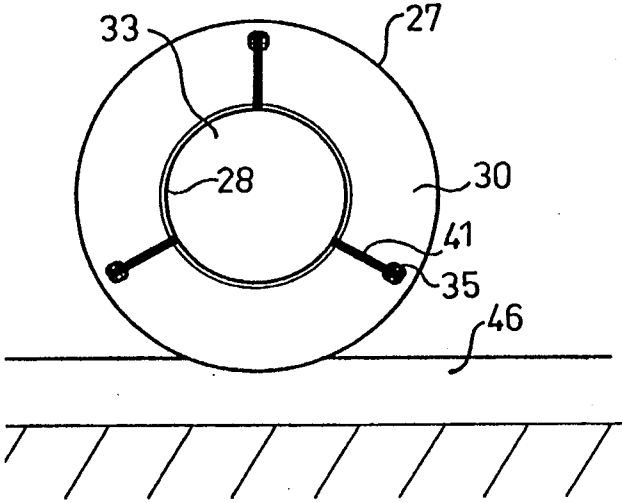

FIG. 10*b* is an end view of the cable or line parcel shown in FIG. 10*a*.

FIGS. 11*a*, 11*b* and 11*c* are different views of the cable or line parcel and a cradle allowing the cable or line parcel to be moved from standing position to lying position for transportation.

Figures 12A, 12B:
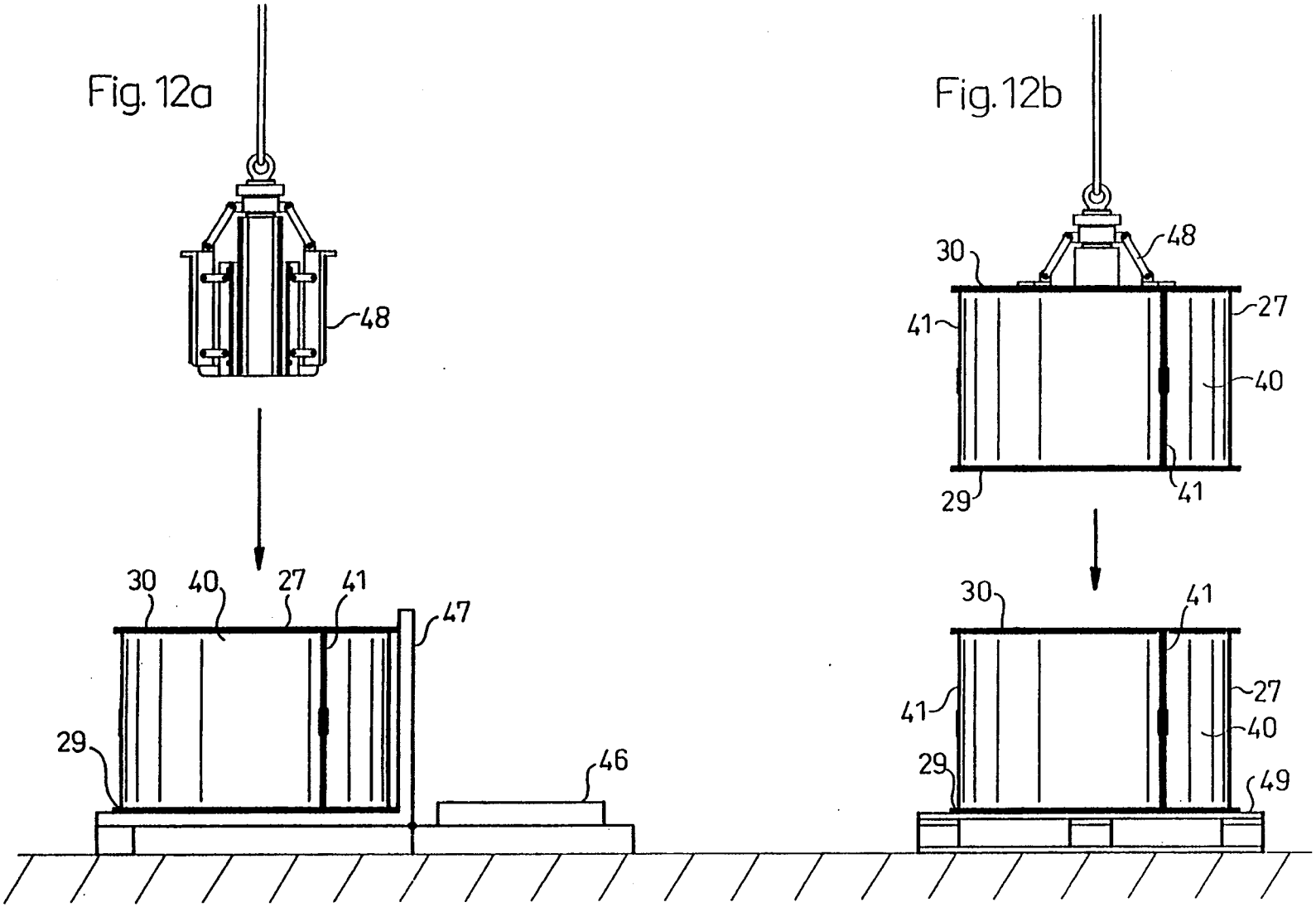

FIGS. 12*a* and 12*b* illustrate movement of the cable or line parcel from the cradle to a loading pallet.

Figure 13A:
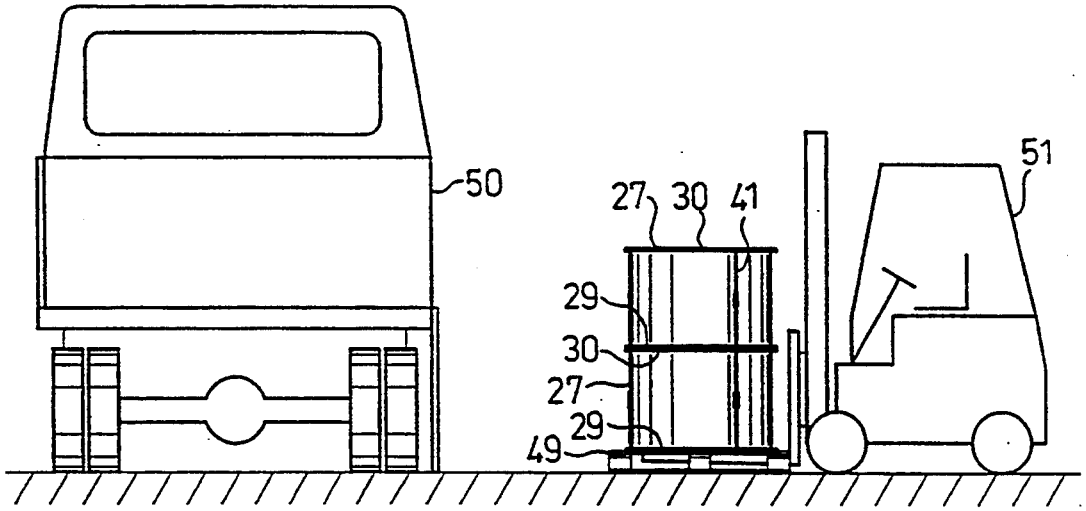
Figure 13B:
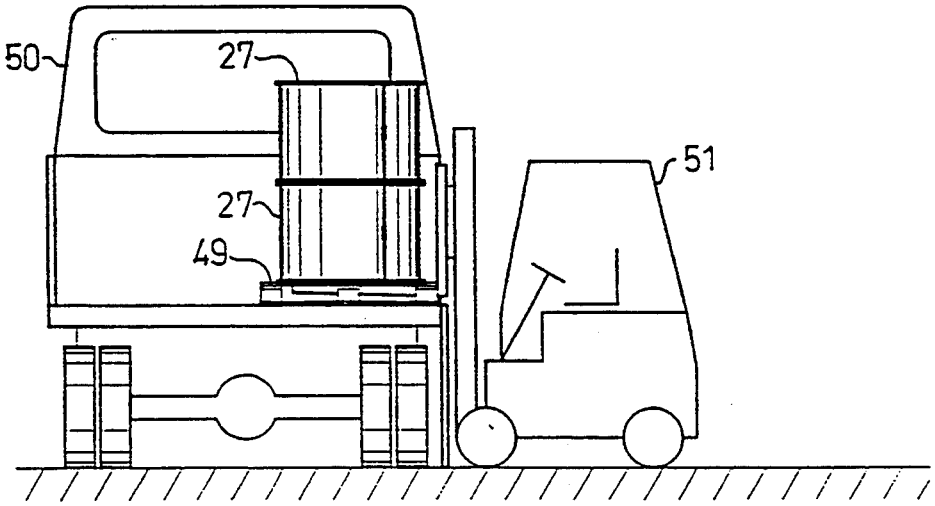

FIGS. 13*a* and 13*b* illustrate loading of the cable or line parcel onto a transport vehicle.

Figure 14A:
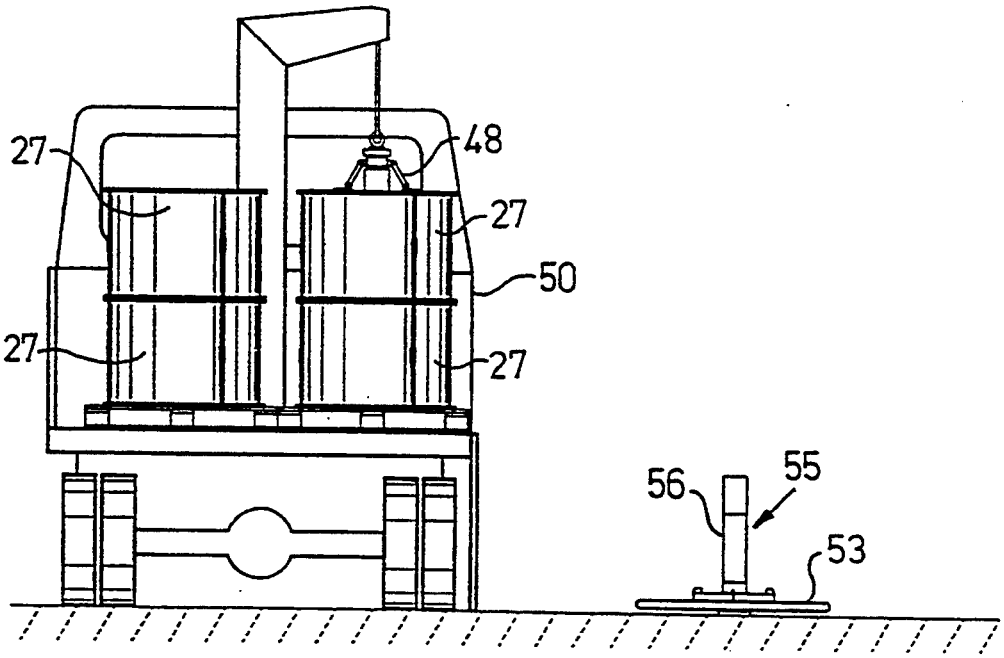
Figure 14B:
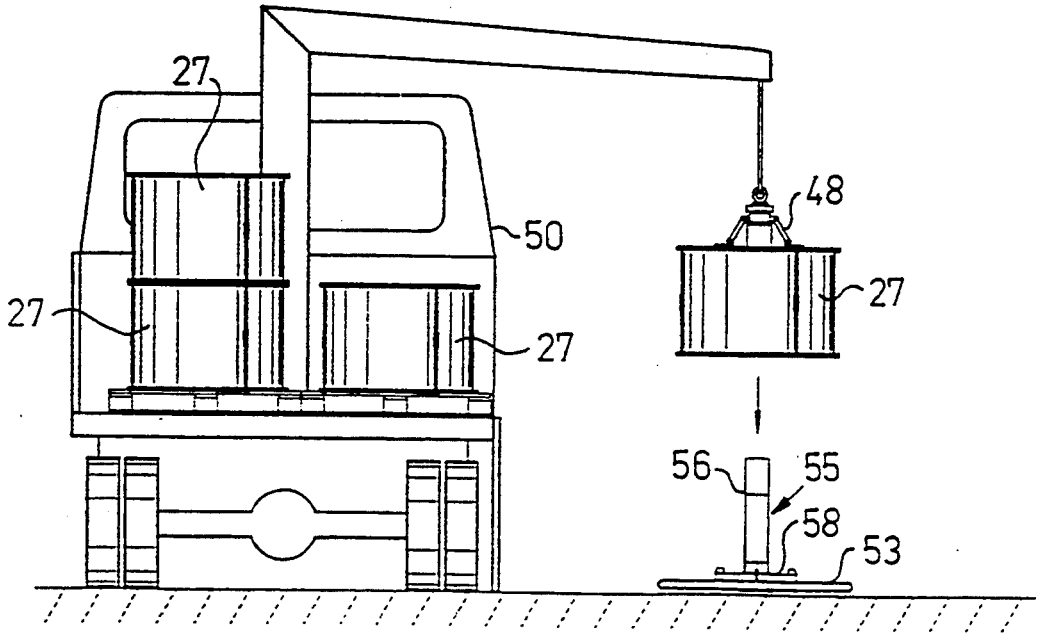

FIGS. 14*a* and 14*b* illustrate the unloading of a cable or line parcel and parts of a second tool which is assembled with the cable or line parcel in connection to a work site in the field to form a second rotatable unit.

Figures 15A, 15B, 15C, 15D:
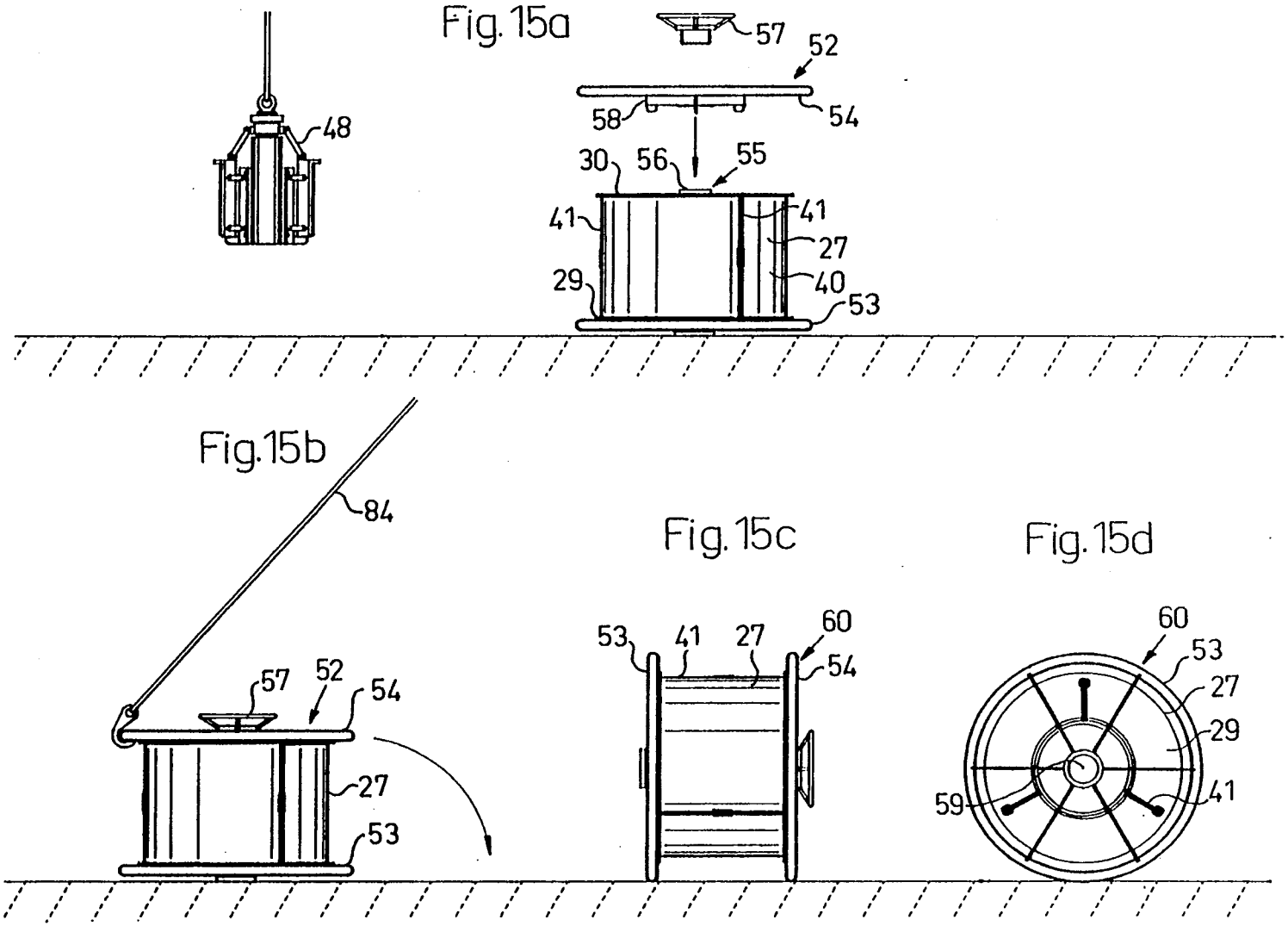

FIG. 15*a* illustrates assembly of the other parts of the second tool for producing the second unit.

FIGS. 15*b*, 15*c* and 15*d* illustrate the assembled, rotatable second unit of cable or line parcel and tool, FIG. 15*b* showing a lifting wire with hook for raising the unit to standing position.

Figure 16A:
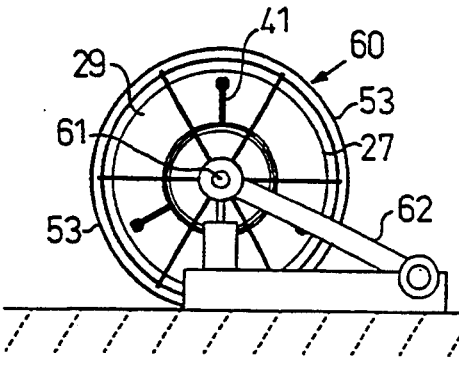
Figure 16B:
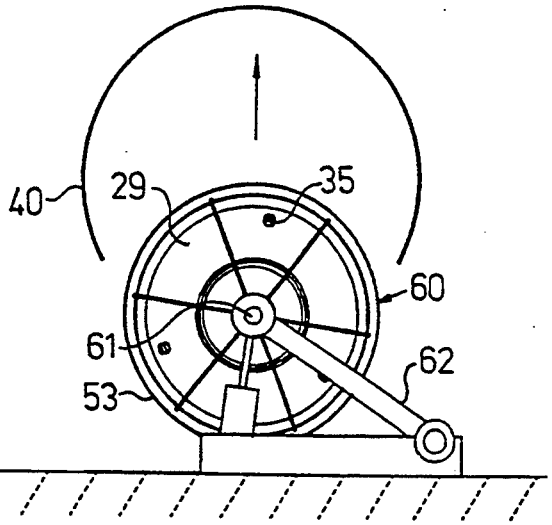

FIGS. 16*a* and 16*b* illustrate an uncoiling trestle with the second unit rotatably journalled therein.

Figure 17:
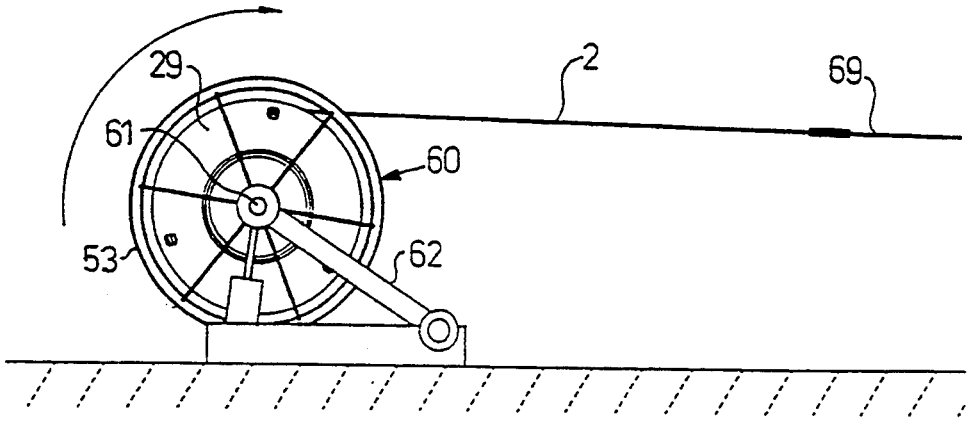

FIG. 17 illustrates the uncoiling of the cable or line from the second unit.

FIG. 18 illustrates the second unit when uncoiling of the cable or line has been completed.

FIGS. 19*a* and 19*b* illustrate dismantling of the second tool.

Figure 20:
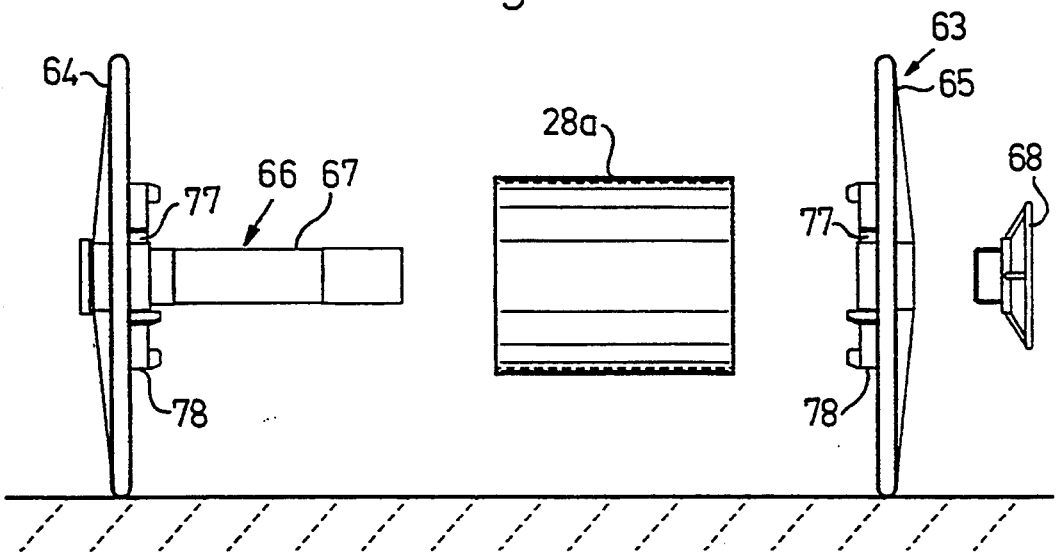

FIG. 20 is an exploded view of a third tool and associated sleeve for assembly to a rotatable third unit for coiling a scrap line.

Figure 21A:
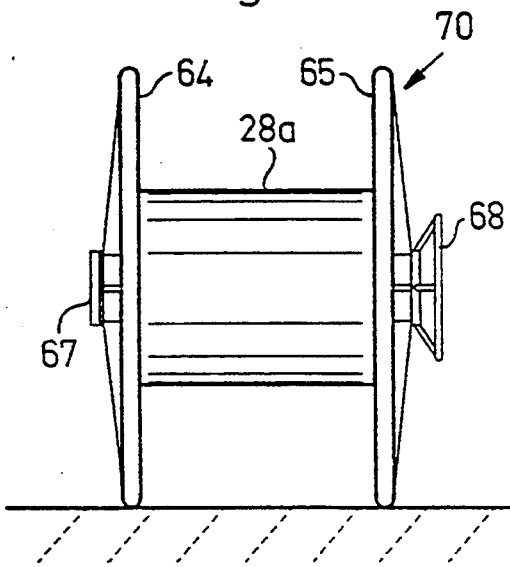
Figure 21B:
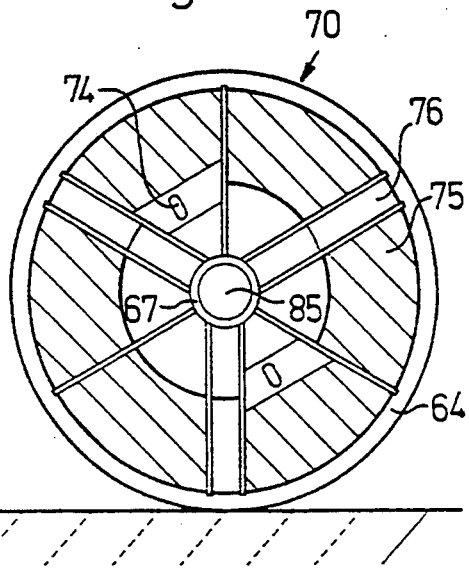

FIGS. 21*a* and 21*b* are side and end views respectively of the third tool and sleeve shown in FIG. 20 assembled to form a third rotatable unit.

Figure 22:
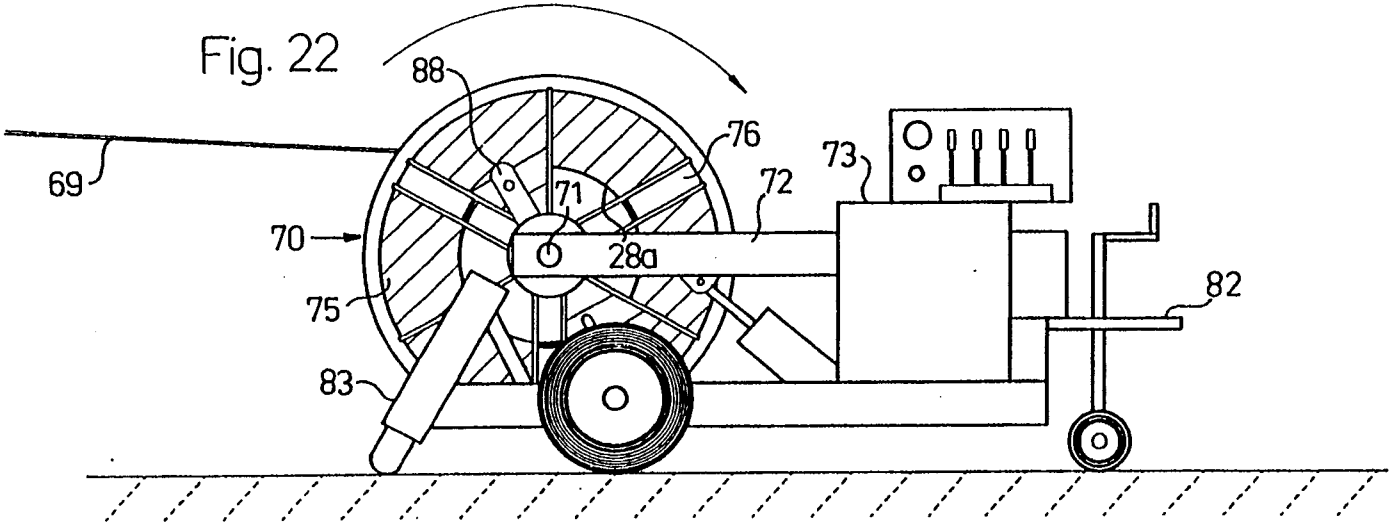

FIG. 22 is a side view of a mobile coiling machine for field use carrying a rotatable third unit according to FIG. 21.

Figure 23:
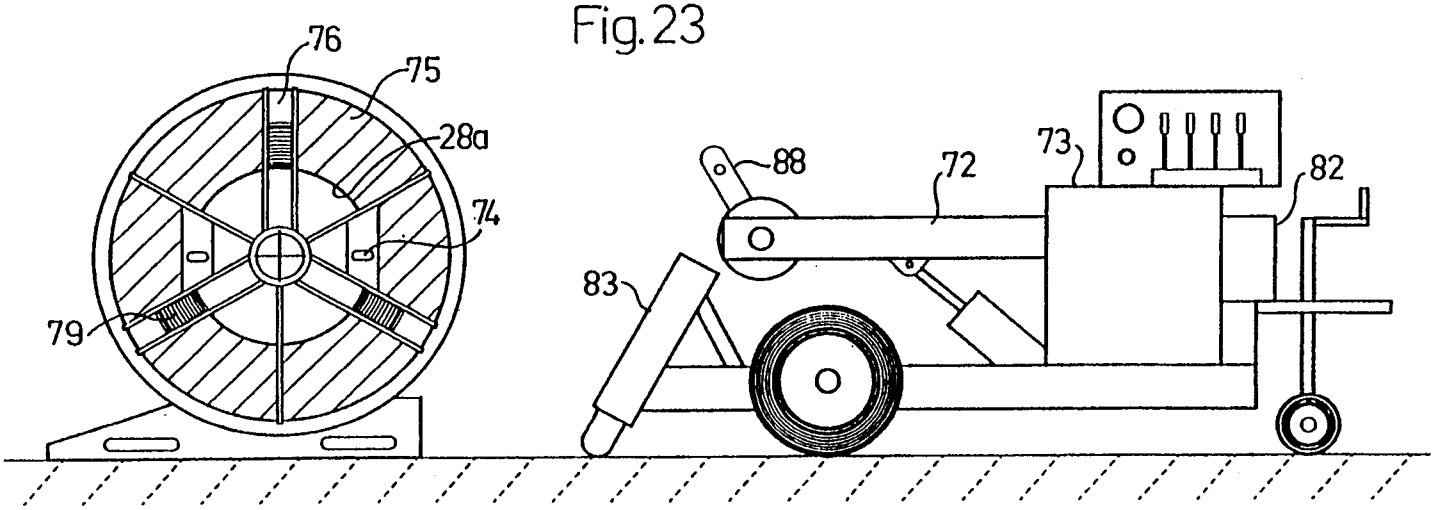

FIG. 23 is a side view of the coiling machine shown in FIG. 22 and the finished coil on the rotatable third unit which has been placed on a ramp for the tool to be dismantled.

Figure 24B:
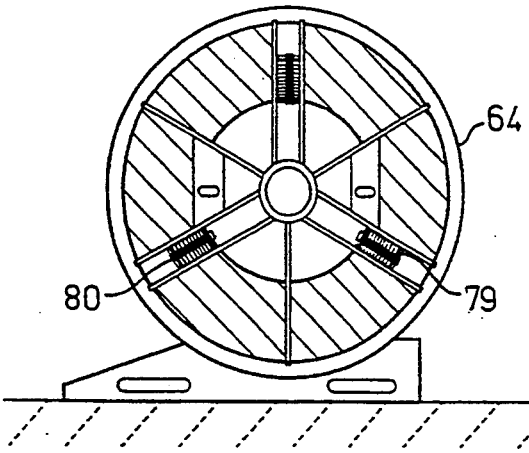
Figure 24A:
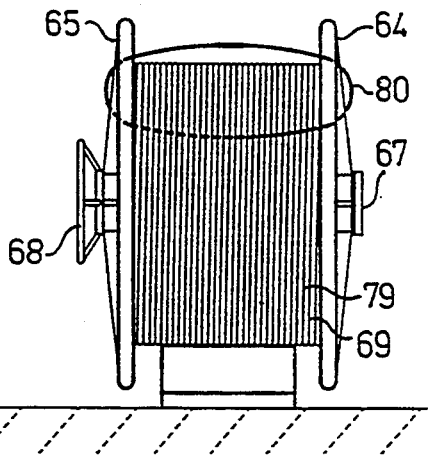

FIGS. 24*a* and 24*b* illustrate how the coil and sleeve are encompassed with bands to form a scrap line parcel.

Figure 25:
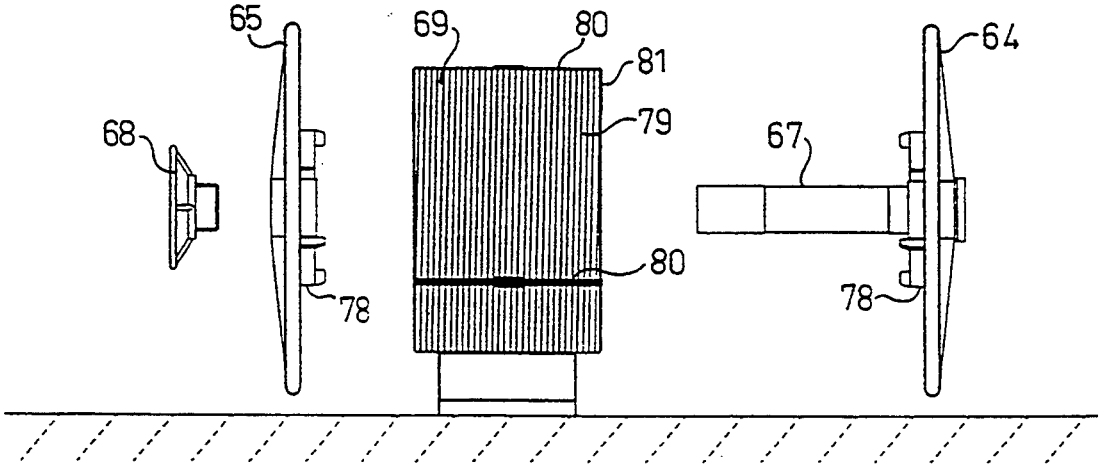

FIG. 25 illustrates the third tool after dismantling and release of the finished scrap line parcel.

Figure 26:
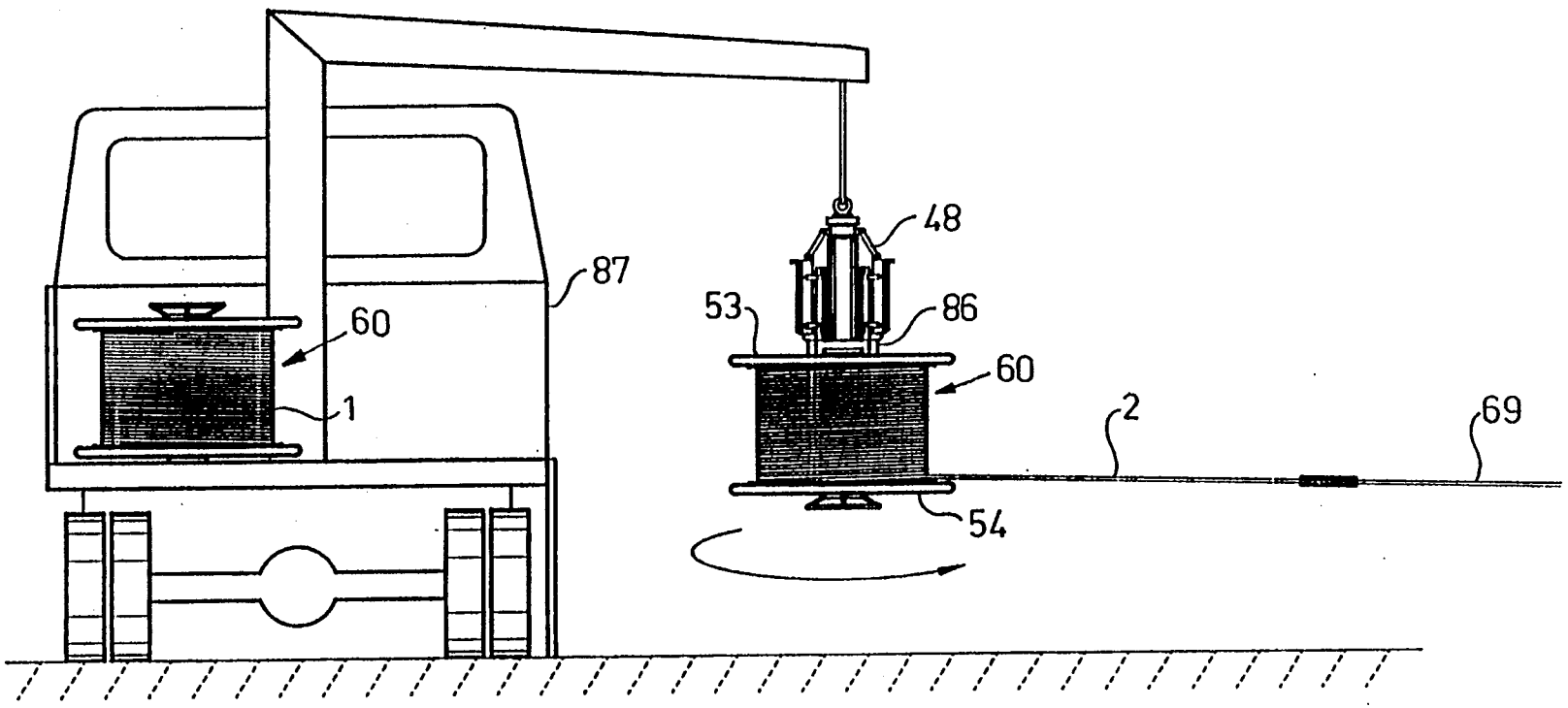

FIG. 26 illustrates an alternative method of uncoiling cable or line with the second tool suspended in an expander gripping device, for rotation about a vertical axis.

Figure 27:
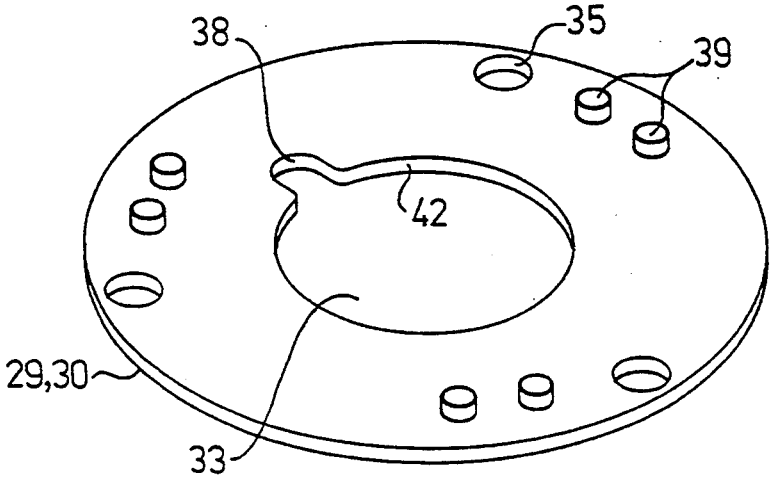

FIG. 27 a perspective view of one embodiment of a protective ring for the cable or line parcel according to FIG. 10*b*.

Figure 28:
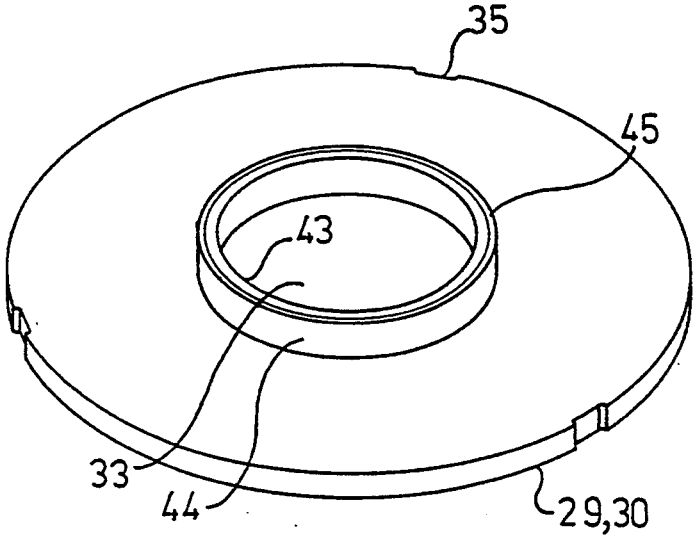

FIG. 28 is a perspective view of a further embodiment of a protective ring for the cable or line parcel according to FIG. 10*b*.

Figure 1:
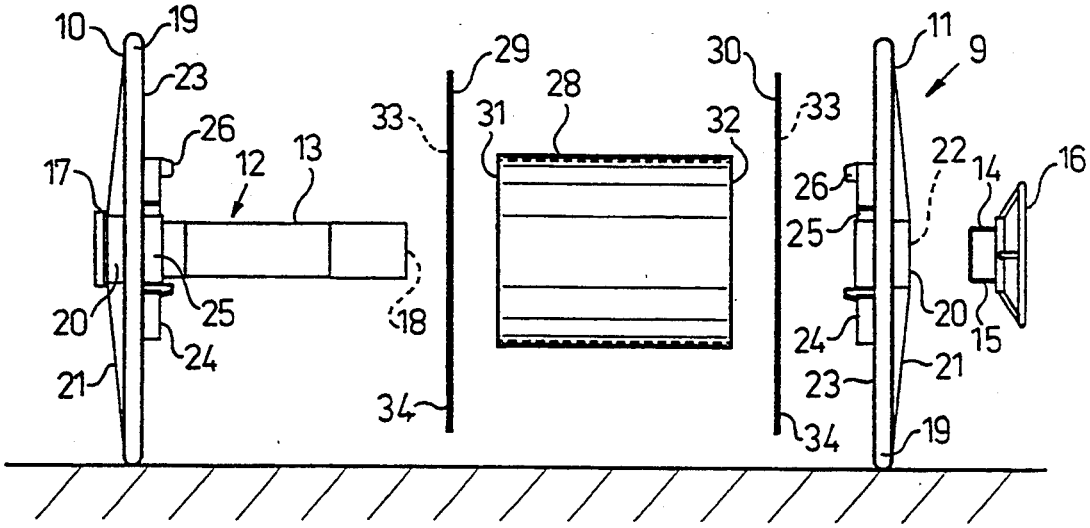

FIGS. 3–6 illustrate schematically the production of a coil 1 of a continuous easily flexible object 2 in a stationary coiling machine 3 located in a factory. For the sake of simplicity and as a preferred embodiment of the invention, the object is described in the following as a cable or line. However, the invention is applicable to other types of similarly easily flexible objects, i.e. objects which can be coiled or wound about a cylindrical core, such as wire, wire cable, rope, cord, ribbon, hosing, chain and the like. The coiling machine has two support arms 4, 5, pivotable about a horizontal axis, the support arms supporting journalling means in the form of two axially aligned spindles 6, 7. The support arms can be moved in relation to each other, thereby moving the spindles 6, 7 from a free starting position as shown in FIG. 3 to an engagement position as shown in FIG. 4*a* in which the spindles 6, 7 have been moved axially towards each other. One spindle is driven by a motor 8 in a certain direction. The coiling machine 3 comprises a simple assembly and dismantling first tool 9 for repeated use at the factory. As is shown in FIG. 1, this tool consists of two circular, wheel-like form-stable side supports 10, 11 of metal, e.g. steel or aluminium, and a longitudinal connecting means 12 of metal to position the side supports 10, 11 in fixed relation to each other. The connecting means 12 has a central hole 37 running axially through it (FIG. 2*b*) and consists of a hollow shaft 13 of predetermined length and a hollow locking device 14 with external threading 15 and a wheel 16 to facilitate turning of the locking device 14. The shaft 13 is provided at one end with a flange 17 forming a counter support and at the other end with internal threading 18 adapted to be screwed into the thread 15 on the locking device 14. Alternatively the flange 17 may be replaced by a locking device similar to the locking device 14 and internal threading at the other end of the shaft 13 also. In both cases the connecting means 12 and the side supports 10, 11 are provided with cooperating engagement or pusher means (not shown) so that they are secured to each other for common rotation. Each side support 10, 11 comprises an outer, stable circular ring 19 of tube, a hub 20 and a plurality of spokes 21 which support and center the hub 20 and define functional openings 89 between them. The hub 20 is provided with a central aperture 22 (broken line in FIG. 2*b*), the diameter of which is suited to the diameter of the shaft 13 So that this can be slidably inserted through the central aperture 22 without a gap appearing between the sliding surfaces which would disturb the stability or centering. Each side support 10, 11 has an inner side formed by the spokes 21 and support surfaces 23 spaced from the hub 20 which are located in a common plane lying parallel to the plane of corresponding support surfaces 23 on the other side support 11 or 10. Each side support 10, 11 is also provided on its inner side with a centering element 24 located concentrically with the hub and having a predetermined axial length and predetermined radius. In the embodiment shown the centering element 24 consists of three evenly distributed circular arc shaped parts forming functional openings 25 between them. The support surfaces 23 of the spokes 21 are located radially outside the centering elements 24. The centering elements 24 are suitably provided with a plurality of guide bosses 26, the outer sides of which incline inwardly and are located in a conical surface generated by the outer sides.

To produce a cable or line parcel 27 according to the present invention a core 28 is used and two circular, annular flat protective discs 29, 30 lockably joined to the core 28, said discs forming the end walls of the finished cable or line parcel 27. The core 28 thus forms the inner frame or supporting part of the parcel or coil. The core 28 is in the form of a non-deformable, cylindrical, axially open sleeve having predetermined length and diameter. The sleeve wall is thick enough to ensure sufficient strength to avoid deformation due to the stresses to which the cable or line parcel may be subjected. The form-stable sleeve 28 is weather-resistant so that it will not absorb moisture or water even during extended contact with water, preferably for at least three months. Its inner diameter is equal to or only slightly less or greater than the diameter of the centering element 24 so that the end openings of the sleeve can receive the centering element 24 without gap between the cooperating sliding surfaces, thus ensuring exact centering of the sleeve 28 in the tool 9. Said predetermined axial length of the centering element 24 is selected to give sufficient radial support to the sleeve 28 in engagement position. The end surfaces 31, 32 of the sleeve 28 are parallel to each other to ensure that the side supports 10, 11 are parallel to each other in assembled operating position in the coiling machine 3. The end surfaces 31, 32 are thus in contact with the support surfaces 23 formed by the spokes 21. Said flat, i.e. disc-shaped, protective rings 29, 30 have a circular central aperture 33 having a diameter somewhat larger (see also FIG. 27) than the outer diameter of the sleeve 28 so that each protective ring 29, 30 can easily be placed on the sleeve 28 to surround each end portion thereof. The outer sides 34 (FIG. 1) of the protective rings 29, 30 are flat and are located in the same plane as the end surfaces 31, 32 during coiling stage, this plane also constituting the same plane as that in which the support surfaces 23 formed by the spokes 21 are located. The outer diameter of the protective rings 29, 30 is slightly less than the diameter of the side supports 10, 11. In the vicinity of the outer edge of each protective ring 29, 30 is a plurality of, e.g. three, small holes 35 (see FIG. 2*b*) uniformly distributed around the periphery. Their function will be explained below.

Figure 2A:
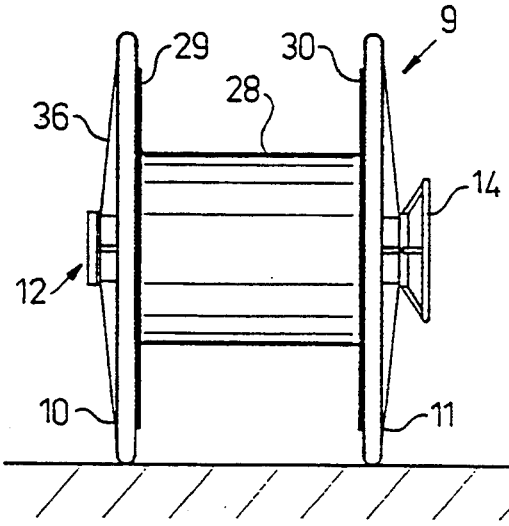
Figure 2B:
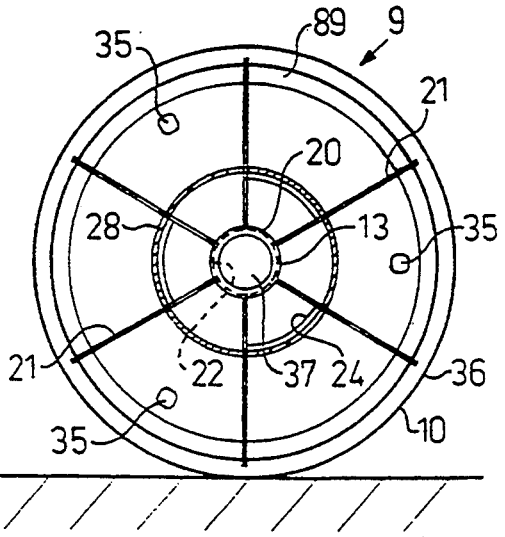
Figure 5:
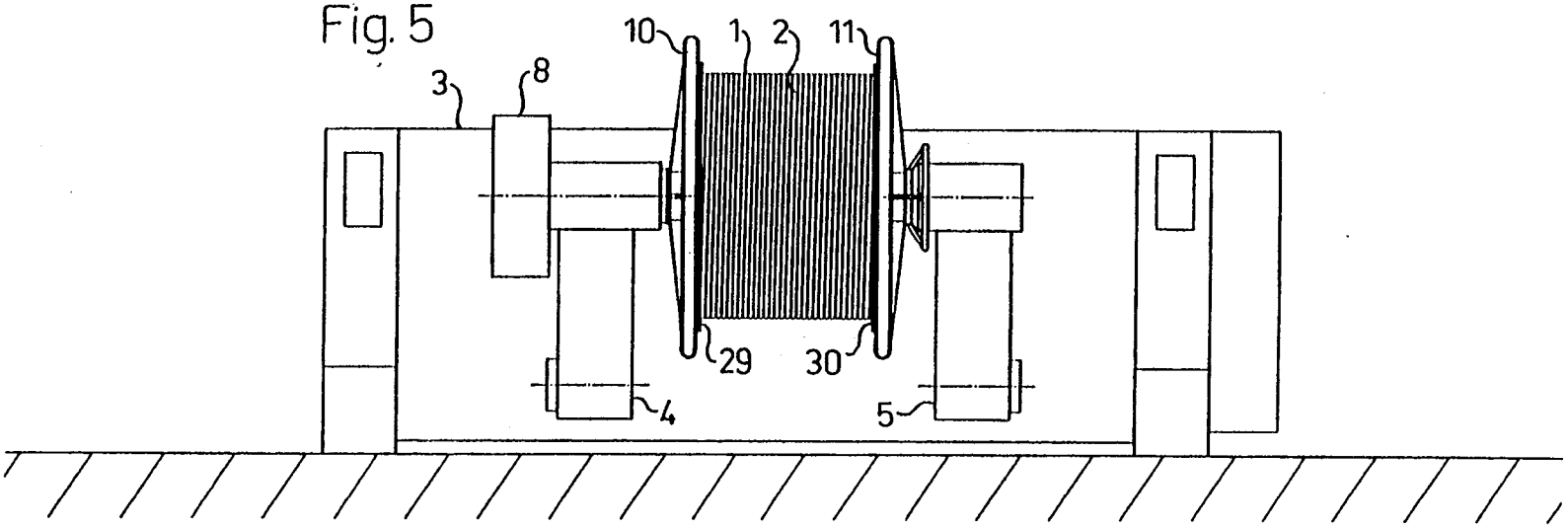
FIG. 5 illustrates the first unit with finished coil ready for lowering to the ground.
Figure 6:
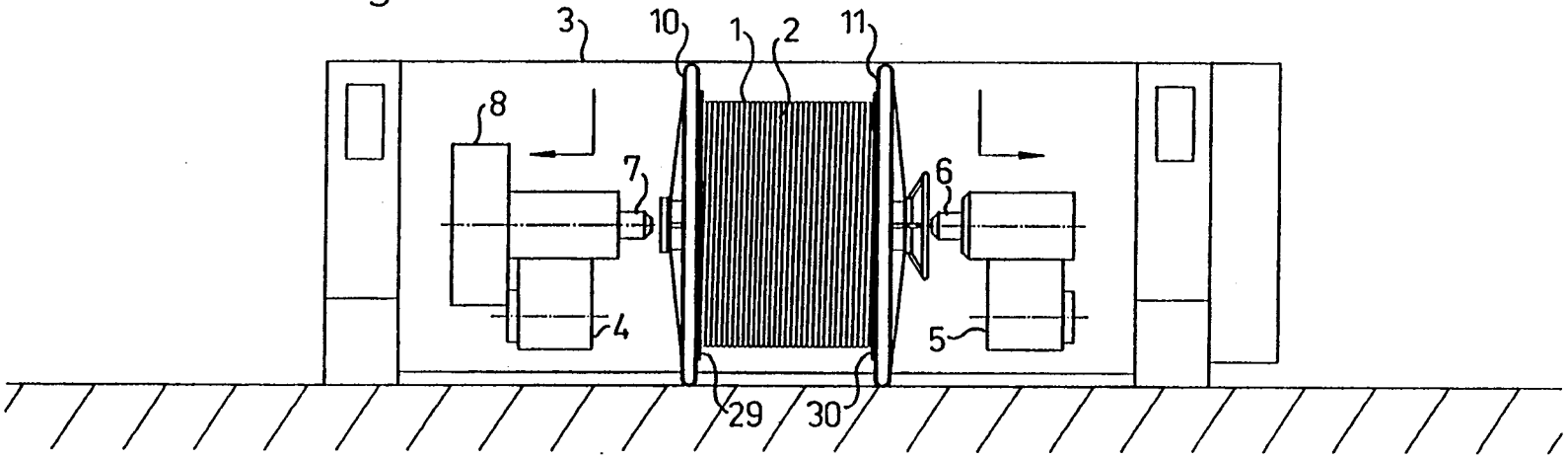
FIG. 6 illustrates the first unit with finished coil released from the coiling machine.

The three parts described so far as comprising the finished cable or line parcel 27, i.e. the sleeve 28 and the two protective rings 29, 30, are assembled on the tool 9 by the hollow shaft 13, passed through one of the side supports 10, 11, being inserted through the axially open sleeve 28 on which the protective rings 29, 30 have been previously applied. Simultaneously, or in an earlier step, the second side support 11 is moved towards the other end 32 of the sleeve 28, and the shaft 13 is fitted into the central aperture 22 in the hub 20. The locking device 14 is then brought into thread engagement with the shaft 13 and turned while the centering elements 24 are pulled into the sleeve 28 to be clamped between the side supports 10, 11, as shown in FIG. 2*a*. Assembly of the sleeve 28 on the centering elements 24 is facilitated by the guide bosses 26. The sleeve 28 is in detachable engagement with the centering elements 24, i.e. it is not necessary to effect a rigid joint using mechanical or chemical attachment means. The first rotatable unit 36 thus obtained, which has an axis of rotation determined by the central hole 37 of the connecting means 12, is then rolled to the coiling machine 3, spindles 6, 7 of which being brought into engagement with the central hole 37 of the shaft 13 and locking device 14, after which the unit 36 is lifted to coiling position as shown in FIG. 4*a*. The end of the cable or line 2 is attached via an aperture or recess 38 (see FIG. 27) in one of the protective rings 29, 30 so that the cable or wire is fixed in relation to the unit 36 during its rotation about its central axis or axis of rotation. This axis of rotation is coaxial with that of the spindles 6, 7 and the unit 36 is rotated in the direction shown in FIG. 4*b* (the wheel 16 has been omitted in said figure). The protective rings 29, 30 are secured to the side supports 10, 11 by suitable fixing means 39 (see FIG. 27) so that they rotate together with the side supports 10, 11. Before fixing, the protective rings 29, 30 are turned so that their peripheral apertures 35 are pairwise axially aligned with each other and so that the apertures 35 are located within the circle-sectors in which said openings 25 of the centering element 24 are located (see e.g. FIG. 4*b*). The cable or line 2 is coiled onto the sleeve 28 as it rotates and a coil 1 with predetermined diameter is obtained, this diameter being slightly less than that of the protective rings 29, 30, as can be seen in FIG. 5. The unit 36 with the cable or line coil 1 is lowered by the support arms 4, 5, and their spindles 6, 7 are removed. The unit including the cable or line coil is then rolled to an adjacent final wrapping station according to FIGS. 7 and 8, where first an axially cut outer protective sleeve 40 of plastic or cardboard is brought to enclose the entire outer surface of the coil 1 as illustrated in FIGS. 7*a* and 7*b*. In the next step the binding means in the form of bands 41 are threaded through the side supports 10, 11, the sleeve 28 and then through the apertures 35 in the protective rings 29, 30, whereafter the bands 41 are stretched taut and their ends joined to a permanent, i.e. strong, joint. Each band thus extends axially with the sleeve and transversely over the turns of the cable or line in an endless loop. The bands, normally of metal or reinforced plastic, surround the sleeve 28, protective rings 29, 30, coil 1 and protective casing 40 and thereby form a finished cable or line parcel 27 in which the cable or line 2 is well protected and clamped tightly so that the turns of cable or wire are fixed close together and are entirely immovable in relation to each other. Spacers may be placed between the protective rings 29, 30 to provide support for the bands 41, preventing them from damaging the cable or line, particularly if the protective casing is thin and the cable or line is of a sensitive type.

Alternatively the tool 9 may be permanently mounted on the support arms 4, 5 so that its side supports 10, 11 can be moved in relation to each other with the aid of the support arms, while the sleeve 28 is aligned axially between the side supports 10, 11 to be brought into engagement with them as described above. In this case the connecting means 12 may be eliminated and the central aperture 22 of the hub 20 can be used as journalling means, e.g. the spindles 6, 7.

FIG. 27 shows a suitable embodiment of a protective ring 29, 30 provided on one side with said fixing means 39 in the form of six short pins intended to be placed pairwise on either side of a spoke 21 of a side support 10, 11, the distance between two pins 39 in each pair being sufficient to allow a spoke 21 to be received freely therebetween. Besides the peripherically placed apertures 35 for receiving the bands 41, a recess 38 is also shown at the edge of the central aperture 33. The end of the cable or line is passed through and secured at this recess when coiling is to be started. In the embodiment of the protective rings 29, 30 described above, the central aperture 33 forms an inner, concentric support surface 42 which cooperates with the opposing outer surface of the sleeve 28. FIG. 28 shows the reverse, with internal detachable engagement for the protective rings 29, 30. The rings are provided on one side with an axially protruding concentric flange 43 enclosing the central aperture 33 and having an outer, concentric, cylindrical support surface 44 intended to be brought into detachable engagement with the opposing internal surface of the sleeve 28. The flange is suitably provided with a bevelled or conical guide surface 45. The protective ring according to FIG. 28 is provided with recesses 35 in its peripheral edge portion for receiving the bands 41.

The tool 9 with the finished cable or line parcel 27 is rolled up onto a ramp 46 so that the side supports 10, 11 are free from the ground, as shown in FIGS. 9*a* and 9*b*, and the tool 9 can be dismantled and removed from the finished cable or line parcel 27 as shown in FIGS. 10*a* and 10*b*. The cable or line parcel 27 is then rolled along the ramp 46 to a cradle 47 where the cable or line parcel 27 is placed on its side for loading, as illustrated in FIGS. 11*a*, 11*b* and 11*c*. With the aid of an expander gripping device 48 the cable or line parcel 27 is then transferred to a pallet 49, the expander gripping device 48 being lowered into the cylindrical space of the sleeve 28 and brought into engagement with the interior of the sleeve, as illustrated in FIGS. 12*a* and 12*b*. Several, e.g. two such finished cable or line parcels 27 can be placed on each pallet 49, as illustrated in FIG. 12*b*. The pallets 49 with the cable or line parcels 27 are loaded onto a transport vehicle 50 with the aid of a fork-lift truck 51, as illustrated in FIGS. 13*a* and 13*b*, for transport to a work site in the field. Thus, according to the invention, the term "parcel" refers to a package which is ready for direct transport to the user, possibly after storage.

The cable or line parcel 27 is unloaded at the work site using the same or another similar expander gripping device 48, as illustrated in FIG. 14*a*. During unloading the cable or line parcel 27 can be lowered onto parts of a second tool 52 (.see FIG. 14*b*) which is simple to assemble and dismantle for repeated use in the field. The second tool is utilized as a necessary aid in uncoiling the cable or line 2. The tool 52 is similar to that used in the coiling machine described above, with respect to number, type and essential design of the main components, and thus comprises two identical side supports 53, 54 of metal such as steel or aluminium, and a longitudinal connecting means 55 of metal, having a central hole 59 running axially through it (FIG. 15*d*) and consisting of a flanged hollow shaft 56 and a hollow locking device 57 to fix the side supports 53, 54 in relation-to each other. The shaft 56 is passed through the central aperture of one of the side supports 53, 54 and is kept vertical since the side support 53 rests on the ground. When the cable or line parcel 27 is lowered the hole thereof receives the shaft 56 which is also received by a central space in the expander gripping device 48 so that the cable or line parcel 27 can be lowered towards the side support 53. The expander gripping device 48 is released and removed, after which the second side support 54 is placed on top of the cable or line parcel 27 (see FIG. 15*a*) and the locking device 57 is then brought into thread engagement with the shaft 56 and turned so that the cable or line parcel 27 is clamped between the side supports 53, 54 at the same time as their centering elements 58, which in this case may be whole rings, center the sleeve 28 to the side supports 53, 54 so that their center axes coincide with that of the sleeve and the cable or line parcel 27. The rotatable second unit 60 thus obtained is then raised to an upright position with the aid of a wire 84 with a hook (see FIGS. 15*b*, 15*c* and 15*d*), and is provided with a longitudinal journalling shaft 61 which is inserted through the central hole 59 of the connecting means 55. The ends of the journalling shaft 61 are placed and secured in an uncoiling trestle 62 so that the tool 52 and cable or line parcel 27 can rotate freely on the journalling shaft 61 (see FIG. 16*a*). The bands 41 are then cut and the protective casing 40 removed, as illustrated in FIG. 16*b*, after which the free end of the cable or line can be joined to one end of a traction line 69 (see FIG. 17), the other end of which is located at an other remote work site to coil the traction line. When the cable or line has been uncoiled (FIG. 18), the empty second unit 60 is removed from the uncoiling trestle 62 (FIG. 19*a*) and the tool is dismantled (FIG. 19*b*) for re-use. The sleeve 28, protective rings 29, 30 and protective casing 40, on the other hand, constitute disposable packaging and are burned on site or collected.

At said second work site a third tool 63 (see FIG. 20) is used which is simple to assemble and dismantle. This tool is similar to that used in the stationary coiling machine 3 at the first work site for uncoiling, with respect to number, type and essential design of the main components, and thus comprises two identical side supports 64, 65 of metal such as steel or aluminium, and a longitudinal connecting means 66 of metal, having a central hole 85 running axially through it (FIG. 21*b*) and consisting of a flanged hollow shaft 67 and a hollow locking device 68 to fix the side supports in relation to each other. This third tool 63, which is used repeatedly in the field, is assembled in the same way as the tools 9, 52 described earlier, while centering and clamping a sleeve 28*a* (see FIGS. 21*a* and 21*b*) onto which the traction line 69 is to be wound. The rotatable third unit 70 thus obtained is provided with a longitudinal journalling shaft 71 which is inserted through the central hole 67 of the connecting means 66. The ends of the journalling shaft 71 are placed and journalled in a coiling trestle 72 (see FIG. 22) with driving motor 73 and transmission means for rotation of the tool 63 and the sleeve 28*a* via the journalling shaft 71, suitable pushers 88 being in engagement with the tool via apertures 74 to achieve common rotation. The coiling trestle 72 is suitably rigidly disposed on a transport trolley 82 with flap-down support means 83. Since in this case no protective rings 29, 30 need be combined with the sleeve 28*a*, the side supports 64, 65 are provided with walls 75 of sheet-metal, for instance, which provide direct support for the traction line 69. Radial openings 76 are provided in the walls 75 in alignment with axial openings 77 (FIG. 20) in the centering elements 78. These openings 76, 77 enable the finished coil 79 to be encompassed by bands 80 in the same way as in the manufacture of the cable or line parcel 27. The sleeve 28*a* preferably consists of an empty sleeve 28 obtained from a previous uncoil, and consists of a material which can be burned when the coil of traction line 69, which in this case is a scrap line, is melted in the melting plant of the line manufacturer. The coil 79 is thus transported to the melting plant as an unpackaged parcel 81 in which the turns of the line are fixed by the encompassing bands 80.

Alternatively the second and third tools 52, 63 may also be permanently mounted in a journalling device which may be carried by a vehicle or transport trolley and which have support arms permitting parallel movement of the side supports to clamp and release a sleeve 28; 28*a* with or without coil. In this case the connecting means 55, 66 may be omitted.

In the embodiment shown the tools with sleeves are arranged to be journalled for rotation about a horizontal axis of rotation. Thanks to the invention it is now possible to arrange the tools with sleeves so that they rotate about a vertical axis of rotation, as illustrated in FIG. 26. This offers advantages, particularly when uncoiling, since the uncoiling trestles can be eliminated and the uncoiling site can be selected more easily since the expander gripping device 48, which in this case is rotatable about its vertical axis, can be brought into engagement with one of the side supports 53, 54 with the aid of lower hooks 86, after which the tool 52 with the cable or line parcel 27 is lifted with the aid of the gripping device 48 so that it can rotate freely about the vertical central axis of the gripping device. The gripping device can be supported by a suitable vehicle 87 which also transports the tool with cable or line parcel to an appropriate starting point of the power transmission area for uncoiling of the cable or line.

Besides the protective rings 29, 30 forming stable packaging for both ends of the cable or line parcel to protect the coil 1 during handling of the parcel 27, they also serve as auxiliary support for the side supports 10, 11; 53, 54. The latter can then be designed with considerable savings in material and having weight-reducing openings as with the preferred open wheels with spokes illustrated. Thanks to such open wheels 10, 11; 53, 54 provided with spokes, the mounted second unit 60 consisting of the cable or line parcel 27 and the second tool 52 can easily be coupled to a lifting device by means of a wire 84 with hook, for instance, as shown in FIG. 15*b*, without subjecting this unit to any damaging strain.

The sleeve 28 may be whole as shown, or may consist of two cylinder halves, for instance, which can be fixed to each other merely with the aid of the surrounding protective rings 29, 30 or with the aid of suitable binding agent or attachment means if so desired. The split sleeve takes less space prior to use in the coiling machine 3 since the halves can be stacked inside each other, thus saving valuable transport and storage space. The sleeve 28 may be made of cardboard, wood fibers such as chips and shives, or plastic. Sleeves of cardboard are preferably parallel-wound. Sleeves of wood fibers are preferably compression moulded of a mixture of wood fibers and a suitable binder which is not detrimental to the environment. The protective rings 29, 30 may consist of wood fibers like the sleeve and may be produced by compression moulding, like the sleeve, or they may consist of plastic or wood-fiber sheets, e.g. plywood. The sleeves and protective rings are weatherproof so they will withstand moisture and water under very extreme conditions outdoors for a period of preferably at least three months. For this purpose they may be treated with suitable protective agents, such as paraffin, during or after manufacture to give the material the desired water-repellent properties.

Each cable or line parcel 27 is manufactured using fresh packaging materials consisting of sleeve, protective rings and protective casing. Said materials are not living materials which ensures: that coiling can be performed with the desired accuracy since the dimensions of the packaging materials are maintained; that the coil is not subjected to any stress; and that there will be no movement within the coil prior to uncoiling, due to expansion or contraction of the adjacent material as is the case with the known wooden drums. During storage and transport the cable or line parcel is free from any connecting means extending through the center of the cable or line parcel. The binding means, i.e. the bands 41, are in contact with the inside of the sleeve or are close to the inner side, i.e. at a distance from the center. The interior of the sleeve is thus accessible to a gripping device enabling the cable or line parcel to be lifted safely and even suspended for rotation about a vertical axis of the gripping device, thus offering an entirely new, simplified uncoiling technique.

The length of the sleeve is adjusted to the quantity of cable or line required in the cable or line parcel. Just a few different sizes can be used for the protective rings to cover the need of various lengths of cable and line ordered by the user.

The tools described above are thus intended for repeated use at their respective sites and are made of metal in order to attain long life and the desired stability in the three rotatable units. The remaining material in the parcel, i.e. the packaging, is thus disposible material in the handling chain. The tools can as such be designated journalling members for common journalling of the sleeve with or without coil in journalling means of the stationary coiling machine and the movable coiling and uncoiling devices used in the field.

I claim:

1. A method of handling a coil of a continuous flexible object, using a hollow sleeve, a pair of fiat protective rings dimensioned to cooperate with opposite axial ends of the sleeve, a pair of side supports, a shaft releasably connectable to the side supports, and a coiling machine including bearing means, said method comprising the steps of substantially sequentially:

(a) providing the sleeve between the protective rings and the pair of side supports at opposite axial ends thereof with said protective rings engaging said side supports and the axial ends of the sleeve, with the shaft passing through and unconnected to the hollow sleeve except at the opposite axial ends thereof, and releasably connecting the shaft and both side supports, to produce a rotatable unit;

(b) journalling the rotatable unit in the coiling machine by moving the bearing means into operative association with the rotatable unit;

(c) attaching the continuous flexible object to the rotatable unit;

(d) with the coiling machine, rotating the rotatable unit so that the continuous flexible object is wound to form a coil of the continuous flexible object wrapped around the sleeve;

(e) cutting the continuous flexible object after a coil of desired dimensions has been formed, defining a free end of the continuous flexible object;

(f) placing a protective casing around the coil concentric with the sleeve, distinct from the side supports; and (g) binding the protective casing to the sleeve and protective rings to hold the coil tightly on the sleeve without relative movement between turns of the coil, to produce a package.

2. A method as recited in claim 1 wherein steps (a)–(g) are practiced using as the continuous flexible object a cable, line, wire, rope, cord, ribbon, hose, or chain.

3. A method as recited in claim 2 using a second coiling machine, and comprising the further steps of:

(h) transporting the package from step (g) to a location remote from the coiling machine;

(i) connecting the package side supports and shaft to the second coiling machine for rotation of the sleeve about an axis of rotation;

(j) unbinding the protective casing and removing the protective casing from the coil; and (k) unwinding the continuous flexible object of the coil from the sleeve by rotating the sleeve about the axis of rotation defined by the second coiling machine.

4. A method as recited in claim 3 comprising the further steps of, after step (k), removing the side supports from the second coiling machine; removing the side supports and shaft from the sleeve and protective rings; reusing the side supports and shaft; and discarding the sleeve and protective rings.

5. A method as recited in claim 3 wherein step (k) is practiced by connecting a traction line to the end of the continuous flexible object, by connecting the traction line to a rotatable unit associated with a third coiling machine; and rotating the rotatable unit on the third coiling machine to wrap the traction line onto the rotatable unit on the third coiling machine, until the traction line is essentially completely filled up on the third coiling machine and the continuous flexible object is essentially completely uncoiled from the package.

6. A method as recited in claim 5 comprising the further step (l), between steps (g) and (h), of disconnecting the rotatable unit from the coiling machine, and disconnecting the package from the side supports and shaft so that the package is distinct and separate from the coiling machine, shaft and side supports.

7. A method as recited in claim 6 comprising the further step (m), between steps (h) and (i), of connecting the package to a second pair of side supports and shaft.

8. A method as recited in claim 5 wherein the rotatable unit on the third coiling machine comprises a second hollow sleeve of material which burns if immersed in molten metal without leaving significant amounts of undesirable residues in the molten metal; and comprising the further step, after the traction line has been completely wound on the second hollow sleeve, of detaching the traction line from the continuous flexible object, detaching the coiled metal traction line and second hollow sleeve from the third coiling machine, transporting the traction line coil and second hollow sleeve to a plant for recycling of the metal of the traction line; and immersing the metal traction line coil and hollow sleeve in molten metal to melt the metal of the traction line coil and to burn the second hollow sleeve.

9. A method as recited in claim 3 further utilizing a plurality of bands of metal or reinforced plastic, and wherein the protective rings have openings therein for receipt of the bands; and wherein step (g) is practiced by wrapping a plurality of the metal or reinforced plastic bands through the openings in the protective rings, through the interior of the tubular sleeve and around the exterior of the protective casing and attaching the ends of the bands together in a permanent joint; and wherein step (j) is practiced by cutting the bands and removing the protective casing after the bands have been cut.

10. A method as recited in claim 3 wherein the continuous flexible object is power transmission line, and wherein step (k) is practiced to replace an old power transmission line with the power transmission line of the coil on the sleeve.

11. A method as recited in claim 1 comprising the further step (h) of detaching the rotatable unit from the coiling machine, and the package from the side supports and shaft, so that the package is distinct and separate from the coiling machine, shaft, and side supports.

12. A method as recited in claim 11 using a second pair of side supports and shaft and a second coiling machine, and comprising the further steps of:

(i) transporting the package from step (h) to a location remote from the coiling machine;

(j) connecting the package to a second pair of side supports and shaft to form a second rotatable unit;

(k) journalling the second rotatable unit to the second coiling machine for rotation of the sleeve about an axis of rotation;

(l) unbinding the protective casing and removing the protective casing from the coil; and (m) unwinding the continuous flexible object of the coil from the sleeve.

13. A method as recited in claim 12 wherein step (m) is practiced by connecting a traction line to the end of the continuous flexible object, by connecting the traction line to a rotatable unit associated with a third coiling machine; and rotating the rotatable unit on the third coiling machine to wrap the traction line onto the rotatable unit on the third coiling machine, until the traction line is completely filled up on the third coiling machine and the continuous flexible object is essentially completely uncoiled from the package.

14. A method as recited in claim 13 wherein the rotatable unit on the third coiling machine comprises a second hollow sleeve of material which burns if immersed in molten metal without leaving significant amounts of undesirable residues in the molten metal; and comprising the further step, after the traction line has been completely wound on the second hollow sleeve, of detaching the traction line from the continuous flexible object, detaching the coiled metal traction line and second hollow sleeve from the third coiling machine, transporting the traction line coil and second hollow sleeve to a plant for recycling of the metal of the traction line; and immersing the metal traction line coil and hollow sleeve in molten metal to melt the metal of the traction line coil and to burn the second hollow sleeve.

15. A system for handling a continuous flexible object, comprising:

a tubular sleeve having opposite axial ends and an open central portion between said axial ends;

a pair of fiat protective tings engaging opposite axial ends of said sleeve;

a pair of substantially identical first side supports;

a first shaft passing through said open central portion of said sleeve between said opposite axial ends thereof, concentric therewith and unconnected to said sleeve except at the axial ends thereof, and a releasable connection between said first shaft and both of said side supports, said side supports engaging said protective tings on said opposite axial ends of said sleeve with said protective rings between said side supports and said opposite axial ends of said sleeve;

a first coiling machine including bearing means movable axially into and out of operative engagement with said shaft for rotating said shaft about an axis concentric with said sleeve; and packaging means for holding a coil of a continuous flexible object on said sleeve.

16. A system as recited in claim 15 wherein said shaft is operatively but releasably connected to one or both of said side supports by a locking device directly engaging said shaft and one of said side supports.

17. A system as recited in claim 15 further comprising a coil of a continuous flexible object on said sleeve; and wherein said packaging means comprises a protective casing of plastic or cardboard covering the outer peripheral surface of said coil of a continuous flexible object, between said protective rings, and a plurality of bands of metal or reinforced plastic, each band engaging said protective casing, open central portion of said tubular sleeve, and said protective rings.

18. An assembly as recited in claim 17 wherein said sleeve comprises wood fibers which have been compression molded, cardboard which has been parallel wound, or plastic.

19. An assembly as recited in claim 18 wherein said sleeve material, or a treatment for said sleeve material, renders said sleeve weather resistant so that it will not absorb moisture or water even during extended contact with water for at least three months.

20. An assembly as recited in claim 18 wherein said protective rings comprise compression molded wood fibers or wooden boards.

21. An assembly as recited in claim 20 wherein said protective rings material, or a treatment for said protective rings material, renders said protective rings weather resistant so that they will not absorb moisture or water even during extended contact with water for at least three months.

22. A system as recited in claim 15 further comprising at a location remote from said first coiling machine a second coiling machine and a second pair of side supports and a second shaft, third coiling machine, a third pair of side supports, a third shaft, a second tubular sleeve, and a traction line.

23. A system as recited in claim 22 further comprising a coil of power transmission line wrapped around said sleeve.

24. A coil assembly comprising:

a tubular sleeve having opposite axial ends and an open central portion between said axial ends;

a pair of fiat protective rings engaging opposite axial ends of said sleeve;

a pair of substantially identical side supports;

a shaft passing through said open central portion of said sleeve between said opposite axial ends thereof concentric therewith and unconnected to said sleeve except at the axial ends thereof, and a releasable connection between said shaft and both of said side supports; and said protective rings held between and engaging said side supports and said opposite axial ends of said sleeve.

25. An assembly as recited in claim 24 further comprising a plurality of centering elements stationarily mounted to each of said side supports, each centering element having an arcuate surface which engages and centers said sleeve only at the opposite axial ends thereof.

26. An assembly as recited in claim 25 consisting of said sleeve, rings, side supports with centering means, and shaft.

* * * * *